US010588478B2

(12) United States Patent
Alali et al.

(10) Patent No.: US 10,588,478 B2
(45) Date of Patent: Mar. 17, 2020

(54) SINKS INCORPORATING DISHWASHER FUNCTIONALITIES

(71) Applicant: Squall E.M.T. LTD, Rehovot (IL)

(72) Inventors: Etai Alali, Karmey Yosef (IL); Tamir Rubin, Rehovot (IL)

(73) Assignee: SQUALL E.M.T. LTD, Rehovot (IL)

( * ) Notice: Subject to any disclaimer, the term of this patent is extended or adjusted under 35 U.S.C. 154(b) by 72 days.

(21) Appl. No.: 15/756,751

(22) PCT Filed: Sep. 5, 2017

(86) PCT No.: PCT/IL2017/050994

§ 371 (c)(1),
(2) Date: Mar. 1, 2018

(87) PCT Pub. No.: WO2019/049122

PCT Pub. Date: Mar. 14, 2019

(65) Prior Publication Data

US 2019/0133406 A1 May 9, 2019

(51) Int. Cl.
*A47L 15/00* (2006.01)
*A47L 15/42* (2006.01)
(Continued)

(52) U.S. Cl.
CPC ..... *A47L 15/0086* (2013.01); *A47L 15/00* (2013.01); *A47L 15/08* (2013.01); *A47L 15/4251* (2013.01); *E03C 1/2665* (2013.01)

(58) Field of Classification Search
None
See application file for complete search history.

(56) References Cited

U.S. PATENT DOCUMENTS 1,414,634 A * 5/1922 Fassio ..... A47L 15/0086 134/96.1
3,356,097 A 12/1967 Schapp
(Continued)

FOREIGN PATENT DOCUMENTS

CN 107307827 A 11/2017
GB 2348117 9/2000
(Continued)

OTHER PUBLICATIONS

English translation of WO2016017868A1.*
(Continued)

*Primary Examiner* — Michael E Barr
*Assistant Examiner* — Jason P Riggleman
(74) *Attorney, Agent, or Firm* — The Roy Gross Law Firm, LLC; Roy Gross

(57) ABSTRACT

Disclosed herein is a sink incorporating dishwasher functionalities. The sink is mounted, or otherwise installed, on a kitchen countertop and includes a basin and a cover allowing to fluidly seal the basin from above. According to some embodiments of the sink, at least one portion of the walls of the basin, extending along two peripheral directions, is double walled, having an outer wall and an inner wall, such as to define an inner chamber there between. The inner chamber is controllably fluidly coupled to a pressurized fluid source and has apertures on the inner wall for ejecting fluid jets into the basin. In some embodiments of the sink, the cover is a shutter.

18 Claims, 26 Drawing Sheets

(51) Int. Cl.
*E03C 1/266* (2006.01)
*A47L 15/08* (2006.01)

(56) References Cited

U.S. PATENT DOCUMENTS

| | | | | |
|---|---|---|---|---|
| 4,919,162 | A | 4/1990 | Lumby | |
| 10,441,076 | B2 * | 10/2019 | Shin | A47B 77/08 |
| 2003/0205246 | A1 | 11/2003 | Christman et al. | |
| 2012/0103364 | A1 | 5/2012 | Monsrud et al. | |
| 2014/0373885 | A1 * | 12/2014 | Beshears, Jr. | A47L 15/4274 134/57 D |
| 2015/0369471 | A1 | 12/2015 | Williams | |

FOREIGN PATENT DOCUMENTS

| | | | |
|---|---|---|---|
| JP | 0535038 | U | 5/1993 |
| JP | 06034777 | Y | 9/1994 |
| JP | 06039637 | Y | 10/1994 |
| JP | 2000220174 | A | 8/2000 |
| JP | 2009213822 | A | 9/2009 |
| JP | 2017089100 | A | 5/2017 |
| KR | 20150057058 | | 5/2015 |
| KR | 101570844 | B1 | 11/2015 |
| WO | 9425402 | | 11/1994 |
| WO | 2012033350 | | 3/2012 |
| WO | WO2016017868 | A1 * | 2/2016 |

OTHER PUBLICATIONS

International Search Report of PCT/IL2017/050994 Completed Dec. 21, 2017; dated Dec. 26, 2017 3 Pages.
Written Opinion of PCT/IL2017/050994 Completed Dec. 21, 2017; dated Dec. 26, 2017 4 Pages.

* cited by examiner

SINKS INCORPORATING DISHWASHER FUNCTIONALITIES

RELATED APPLICATIONS

This application is a National Phase of PCT Patent Application No. PCT/IL2017/050994 having International filing date of Sep. 5, 2017, which claims the benefit of priority from PCT/IL2017/050238 filed on Feb. 23, 2017. The contents of the above applications are all incorporated by reference as if fully set forth herein in their entirety.

FIELD OF THE INVENTION

The disclosed technology, in some embodiments, relates to the field of dishwashers and more particularly, but not exclusively, to sinks incorporating dishwasher functionalities.

BACKGROUND OF THE INVENTION

Dishwasher sinks are known in the art. A big advantage of such sinks is the space saved by combining the sink and the dishwasher into one. Ideally, a dishwasher sink would: (i) resemble a standard sink in appearance and dimensions; (ii) allow for easy switching between sink and dishwasher modes of operation (e.g. not require the user to mount a custom spray arm); (iii) not require structural modifications to the surroundings of the sink, e.g. to the kitchen countertop, as part of the installation of the dishwasher sink; (iv) have cleaning capabilities comparable with those of a standard dishwasher; and (v) allow for "normal" use of the sink, e.g. to wash a couple of cups, during a washing cycle.

U.S. Pat. No. 4,919,162 to Lumby and Dawkins discloses a sink located dishwasher having a cover for the sink, a rack for dishes locatable in the sink, and a removable spray arm assembly mounted in the sink drain. The spray arm assembly includes a spray arm rotatably mounted at the upper end of a hollow shaft to rotate in the sink below the rack. A pair of seals are provided on the shaft to seal the shaft within the drain. Water is pumped from the drain above both seals and returned to the drain between the seals from where it flows up the hollow shaft and rotates the spray arm.

UK patent application GB 2,348,117 to Drzewiecki et al. discloses an apparatus comprising (a) a wash basin containing a liquid cleaning composition and having an outlet in liquid communication with a drain pipe, the drain pipe being in liquid communication with a waste line; (b) a return pipe, being in liquid communication with the drain pipe and the outlet; (c) a pump in liquid communication with the return pipe; (d) a flow pipe in liquid communication the pump; (e) a means in liquid communication with the flow pipe for supplying the liquid cleaning composition under pressure to a plurality of channels set in the wash basin whereby pressurized liquid cleaning composition is introduced through the channels and into the wash basin.

US patent application US 2012/0103364 to Monsrud et al. discloses a combination dishwashing machine and sink that utilizes a first use solution, comprising: a) a dishwashing machine; b) a sump in fluid communication with the dishwashing machine and configured and arranged to contain the first use solution utilized in the dishwashing machine; c) a pump in fluid communication with the sump; d) a sink; e) a first fluid passageway interconnecting the pump and the sink; and f) a controller operatively connected to the pump and being programmed to signal the pump to direct the first use solution from the sump, through the first fluid passageway, and into the sink, the controller automating the filling of the sink with the first use solution from the sump.

SUMMARY OF THE INVENTION

Aspects of the disclosed technology, in some embodiments thereof, relate to dishwashers. More specifically, aspects of the disclosed technology, in some embodiments thereof, relate to sinks incorporating dishwasher functionalities.

The disclosed technology provides a sink with the above-listed desirable dishwasher functionalities.

Thus, according to an aspect of some embodiments, there is provided a sink incorporating dishwasher functionalities. The sink includes a basin and a cover allowing to fluidly seal the basin from a top thereof. At least one portion of walls of the basin, extending along two peripheral directions, is double walled, having an outer wall and an inner wall, such as to define an inner chamber there between. The inner chamber is controllably fluidly coupled to a pressurized fluid source and has chamber apertures on the inner wall. During a washing cycle, the cover seals the basin and fluid jets are ejected via the chamber apertures into the basin.

According to some embodiments, the sink includes a plurality of double walled portions, each including a respective inner chamber. The inner chambers are fluidly connected to respective pipes. The pipes are controllably fluidly coupled to one or more valves, thereby allowing to selectively supply pressurized fluid to the inner chambers.

According to some embodiments, the inner chambers and the chamber apertures are configured such as to allow selectively targeting any one or more out of a plurality of regions in the basin.

According to some embodiments, the one or more valves are electronic, and the sink further includes at least one controller including electronic circuitry configured to regulate opening and closing of inlet and outlet ports of the one or more valves, such as to allow a fluid to be sequentially ejected from one after another of the inner chambers, or from one group of the inner chambers after another group of the inner chambers.

According to some embodiments, the one or more valves include at least one multi-way valve including a plurality of outlet ports controllably fluidly connected to at least some of the pipes.

According to some embodiments, each of the walls is doubled walled including a plurality of adjacent inner chambers. The at least one controller is configured to regulate the opening and closing of the plurality of outlet ports of the multi-way valve, such that fluid jets ejected from the inner chambers are ejected from one of the inner chambers at a time in a rotating pattern.

According to some embodiments, the basin includes a drain at a base thereof.

According to some embodiments, the sink further includes a pump fluidly coupled to a domestic water installation and configured to supply water at increased pressure, relative to a pressure of the domestic water installation, to the inner chambers.

According to some embodiments, the sink further includes a water heating tank. The base includes base apertures. The water heating tank is controllably fluidly coupled to the base apertures.

According to some embodiments, the sink further includes a second pump, controllably fluidly coupled to the water installation and fluidly connected to the water heating tank. The second pump is configured to supply to the water heating tank water at a pressure higher than a pressure within the water heating tank.

According to some embodiments, the sink further includes a second multi-way valve. The second multi-way valve is controllably fluidly coupled on an inlet port thereof to the water heating tank, and on a plurality of outlet ports thereof to the base apertures.

According to some embodiments, the water heating tank is further controllably fluidly coupled to at least some of the wall apertures.

According to some embodiments, the sink further includes a waste disposal unit fluidly coupled to the drain, and fluidly connected, on the bottom end thereof, to a drain pipe. The drain pipe is fluidly coupled to a sewer.

According to some embodiments, the chamber apertures constitute a first set of apertures. The sink further includes a second set of apertures below the first set of apertures. The second set of apertures includes at least two apertures located opposite one another on two of the walls. The second set of apertures is configured such that fluid jets ejected therethrough during the washing cycle are directed such as to guide waste on the base of the basin, or waste stuck onto the base, onto the drain.

According to some embodiments, the fluids jets functioning to guide food-waste onto the drain, are higher-pressured than the fluids jets ejected by the first set of apertures.

According to some embodiments, each of the fluids jets, functioning to guide food-waste onto the drain, has a larger spread than each of the fluids jets ejected by the first set of apertures.

According to some embodiments, the sink further includes a recirculation valve and a recirculation pump. The recirculation valve is fluidly coupled to the waste disposal unit and is further controllably fluidly coupled to the drain pipe and to the recirculation pump. The recirculation pump is fluidly coupled to the water heating tank and/or to the at least one multi-way valve. The recirculation valve is configured to switch between a first flow configuration and a second flow configuration.

According to some embodiments, the cover is a shutter.

According to some embodiments, the basin is made of a stainless metal, plastic, ceramics, or porcelain, or is cladded at least on an inner surface thereof by a stainless metal, plastic, ceramics, or porcelain.

According to some embodiments, a distance between the inner wall and the outer wall is between about 0.4 cm to about 2.5 cm.

According to some embodiments, the chamber apertures are characterized by a diameter within the range of about 1 mm to about 5 mm.

According to some embodiments, the pump, the water heating tank, and the controller are housed within an infrastructure container unit.

According to some embodiments, the pressurized water source is a domestic water installation.

According to some embodiments, the sink further includes two elongated shutter tracks mounted on opposite sides of a rim of the basin. The shutter tracks are configured to have slid thereon the shutter, thereby switching between the two configurations. Each of the shutter tracks includes one or more holes along a respective length thereof. The shutter and the shutter tracks are configured such that fluid reaching the shutter tracks from a shutter top surface of the shutter is drained via the holes on the shutter tracks.

According to some embodiments, the shutter includes a plurality of serially linked slats, wherein ends of the slats are mounted in the shutter tracks, respectively.

According to some embodiments, each of the shutter tracks includes a recess and a hollow portion. The recess includes a recess bottom surface, a recess wall, and a recess top surface. The recess bottom surface includes the holes. The holes lead from the recess into the hollow portion. A hollow portion bottom (the bottom of the hollow portion) includes a fluid outlet, fluidly coupled to the basin or to a sewer. Each of the slats is concave, including a peak extending along a length thereof. Pairs of adjacent slats define a trough there between, such that on the ends of the slats, the troughs and the recess top surfaces define spaces through which fluid can flow into the recesses.

According to some embodiments, the slats include on the ends thereof rollers configured to allow for sliding motion of the shutter in the shutter tracks.

According to some embodiments, each of the rollers includes a ball or a disc configured for rotation. The ball contacts, or presses against, a respective one of the recess walls.

According to some embodiments, each of the fluid outlets is coupled to the sewer via a drain duct.

According to some embodiments, the shutter is a rolling shutter or is configured to vertically descend.

According to some embodiments, the shutter is made of stainless metal, glass or plastic, or is cladded by stainless metal, glass or plastic.

According to some embodiments, the sink further includes a sleeve mounted below the kitchen countertop perpendicularly thereto. The sleeve is configured for housing the shutter when the shutter is open.

According to some embodiments, the sleeve includes at a bottom thereof a drain-hole.

According to an aspect of some embodiments, there is provided a sink incorporating dishwasher functionalities. The sink includes a basin and a shutter. The basin includes wall apertures on walls thereof. The wall apertures are controllably fluidly coupled to a pressurized fluid source. The shutter is controllably switchable between two configurations:

i. a first configuration, wherein the basin is uncovered; and ii. a second configuration, wherein the shutter fluidly seals the basin from the top thereof.

During a washing cycle, the shutter is in the second configuration and fluid jets are ejected via the wall apertures into the basin.

According to some embodiments, the basin includes a drain at a base thereof.

According to some embodiments, the sink further includes two elongated shutter tracks mounted on opposite sides of a rim of the basin. The shutter tracks are configured to have slid thereon the shutter, thereby switching between the two configurations. Each of the shutter tracks includes one or more holes along a respective length thereof. The shutter and the shutter tracks are configured such that fluid reaching the shutter tracks from a shutter top surface of the shutter is drained via the holes on the shutter tracks.

According to some embodiments, the shutter includes a plurality of serially linked slats. Ends of the slats are mounted in the shutter tracks, respectively.

According to some embodiments, each of the shutter tracks includes a recess and a hollow portion. The recess includes a recess bottom surface, a recess wall, and a recess top surface. The recess bottom surface includes the holes.

The holes lead from the recess into the hollow portion. A hollow portion bottom includes a fluid outlet, fluidly coupled to the basin or to a sewer. Each of the slats is concave, including a peak extending along a length thereof. Pairs of adjacent slats each define a trough there between, such that on the ends of the slats, the troughs and the recess top surfaces define spaces through which fluid can flow into the recesses.

According to some embodiments, the slats include on the ends thereof rollers configured to allow for sliding motion of the shutter in the shutter tracks.

According to some embodiments, each of the rollers includes a ball or a disc configured for rotation. The ball contacts, or presses against, a respective one of the recess walls.

According to some embodiments, each of the fluid outlets is fluidly coupled to the sewer via a drain duct.

According to some embodiments, the shutter is a rolling shutter or is configured to vertically descend.

According to some embodiments, the shutter is made of a stainless metal, glass or plastic, or is cladded by a stainless metal, glass or plastic.

According to some embodiments, the sink further includes a sleeve mounted below the kitchen countertop perpendicularly thereto. The sleeve is configured for housing the shutter when the shutter is open.

According to some embodiments, the sleeve includes at a bottom thereof a drain-hole.

According to an aspect of some embodiments, there is provided a sink incorporating dishwasher functionalities. The sink includes a basin, a cover allowing to fluidly seal the basin from the top thereof, and a waste disposal unit. The basin includes wall apertures on walls thereof and a non-sieved drain at a base thereof. The wall apertures are controllably fluidly coupled to a pressurized fluid source and the non-sieved drain is fluidly coupled to the waste disposal unit. During a washing cycle, the cover seals the basin and fluid jets are ejected via the wall apertures into the basin. At least two of the fluid jets are directed such as to guide waste on the base of the basin, or waste stuck onto the base, onto the non-sieved drain.

According to some embodiments, the fluids jets functioning to guide waste onto the non-sieved drain are ejected at a higher pressure than the rest of the fluid jets.

According to some embodiments, the fluids jets functioning to guide waste onto the non-sieved drain are ejected from wall apertures located on respective bottoms, or near the respective bottoms, of at least two opposite walls from the walls.

Certain embodiments of the present invention may include some, all, or none of the above advantages. Further advantages may be readily apparent to those skilled in the art from the figures, descriptions, and claims included herein. Aspects and embodiments of the disclosed technology are further described in the specification hereinbelow and in the appended claims.

Unless otherwise defined, all technical and scientific terms used herein have the same meaning as commonly understood by one of ordinary skill in the art to which the disclosed technology pertains. In case of conflict, the patent specification, including definitions, governs. As used herein, the indefinite articles "a" and "an" mean "at least one" or "one or more" unless the context clearly dictates otherwise.

BRIEF DESCRIPTION OF THE FIGURES

Some embodiments of the disclosed technology are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION OF SOME EMBODIMENTS

Figure 1:
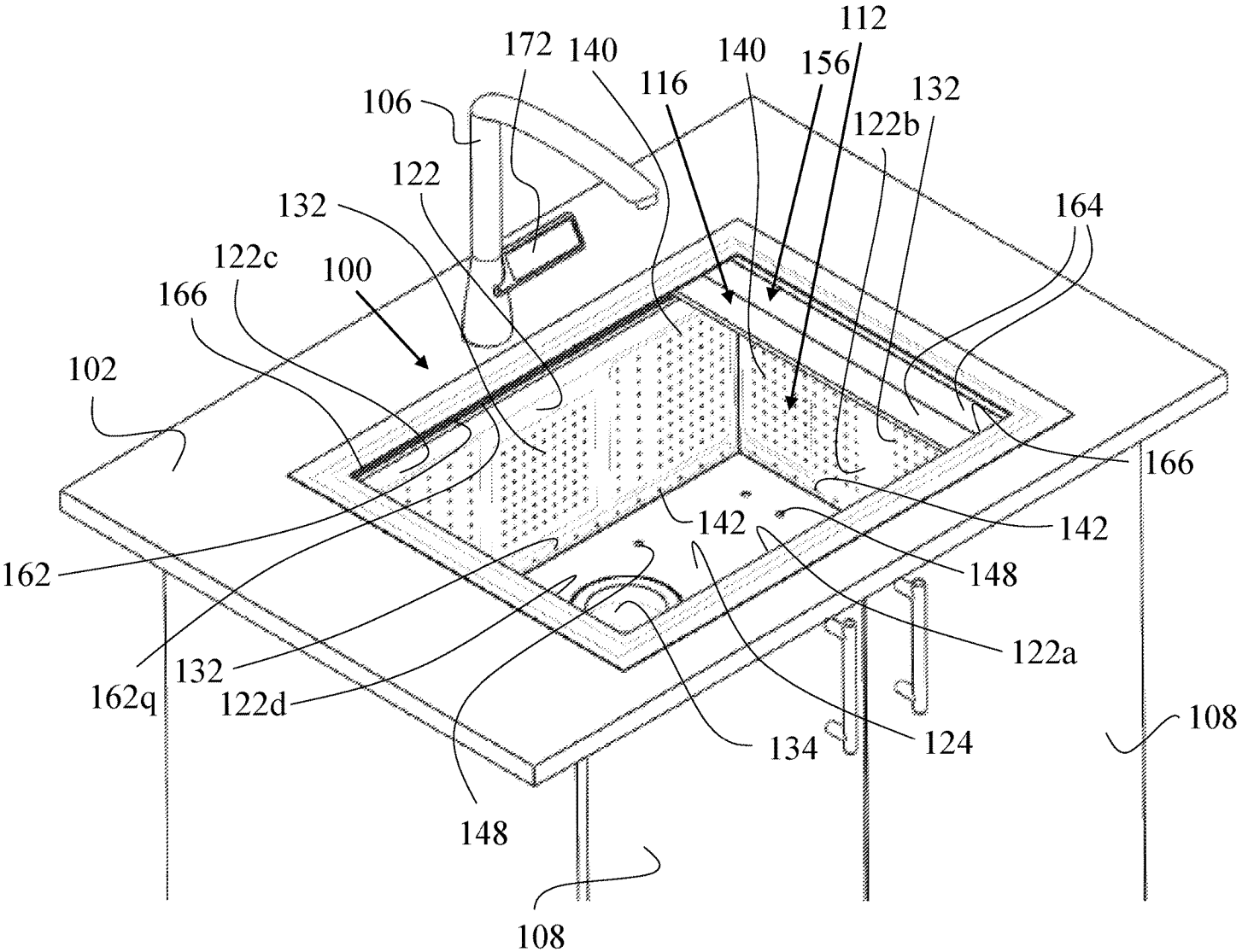
FIG. 1 provides a perspective view of a sink with dishwasher functionalities mounted within a kitchen countertop, according to some embodiments.

The principles, uses and implementations of the teachings herein may be better understood with reference to the accompanying description and figures. Upon perusal of the description and figures present herein, one skilled in the art is able to implement the teachings herein without undue effort or experimentation. In the figures, the same reference numerals refer to the same parts/components throughout.

As used herein, the term "about" means approximately, in the region of, roughly, or around. A parameter or quantity is said to be "about", or equal to "about", a numerical value (e.g. a temperature equals about 50° C.) when it is within a range, thereby extending the boundaries above and below the numerical value. According to some embodiments, "about" is used herein to modify a numerical value above and below the stated value by a variance of 20%. According to some embodiments, "about" is used herein to modify a numerical value above and below the stated value by a variance of 10%. According to some embodiments, "about" is used herein to modify a numerical value above and below the stated value by a variance of 5%.

As used herein, according to some embodiments, the term "comparable" with reference to two parameters/quantities, refers to two parameters/quantities such that neither is greater than the other by a factor greater than three, e.g. two lengths measuring 50 centimeters (cm) and 140 cm, respectively, are comparable, but two lengths measuring 50 centimeters (cm) and 180 cm, respectively, are not comparable. As used herein, the term "comparable" with reference to two parameters/quantities, refers to two parameters/quantities such that neither is greater than the other by a factor greater than four. As used herein, the term "comparable" with reference to two parameters/quantities, refers to two parameters/quantities such that neither is greater than the other by a factor greater than five.

To make the Figures and accompanying description clearer, in some of the Figures a Cartesian coordinate systems is depicted, which may be referred to in the accompanying description. It will be understood that the orientation of Cartesian coordinate systems in depicted in different figures is necessarily maintained from one figure to another. In particular, a stationary element that e.g. points along the x axis in one figure, may point along a different direction in another figure (even though the element has not been moved).

According to a first aspect of the disclosed technology, there is provided a sink with dishwasher functionalities. FIG. 1 provides a perspective view from above of a sink 100 with dishwasher functionalities, according to some embodiments. Further depicted are a kitchen countertop 102, wherein sink 100 is installed, a faucet 106, and doors 108 for accessing a space beneath kitchen countertop 102 housing sink 100 infrastructure components, as detailed below Sink 100 includes a basin 112 and a cover 116. Cover 116 is switchable between two configurations: a first configuration wherein cover 116 is open (i.e. basin 112 is uncovered from above), and a second configuration wherein cover 116 is closed and fluidly seals basin 112 from above (that is to say, cover 116 seals basin 112 from the top thereof). During a washing cycle, cover 116 is closed and, according to some embodiments, locked (similarly to a door of a standard dishwasher or washing machine). Basin 112 includes walls 122 and a base 124. Walls 122 include wall apertures 132 (not all are numbered), as elaborated on below. Base 124 includes a drain 134. According to some embodiments, wherein basin 112 is rectangular, walls 122 include a first wall 122*a*, a second wall 122*b* at right angles (i.e. perpendicular) to first wall 122*a*, a third wall 122*c* opposite (and parallel to) first wall 122*a*, and a fourth wall 122*d* opposite (and parallel to) second wall 122*b*. According to some embodiments, wall apertures 132 include two different sets of apertures having different functions: a first set of apertures 140 (not all are numbered) and a second set of apertures 142 (located near the bottom of walls 122; not all are numbered), as elaborated on below.

According to some embodiments, basin 112 is rounded (e.g. shaped as a half sphere), ellipsoidal and the like.

According to some embodiments, basin 112 is installed in or on kitchen countertop 102, in any suitable configuration. For example, basin 112 can be mounted from above kitchen countertop 102 or within an opening in kitchen countertop 102, the opening may be round, square, rectangular, elliptical or any shape suitable to the corresponding shape of basin 112. It is to be understood that basin 112 can be shaped to any shape, and its functions as detailed herein, do not depend upon its shape.

The term "mounting" as used herein with respect to basin 112 includes, but is not limited to, top mounting, leveled mounting and mounting from below, as well as any suitable mounting.

According to some embodiments, basin 112 is made of any material known in the art suitable for basins. For example, basin 112 is made of stainless metal, plastic, ceramics, or porcelain, or is cladded at least on an inner surface thereof by a stainless metal, plastic, ceramics, or porcelain According to some embodiments, sink 100 includes faucet 106.

According to some embodiments, base 124 further includes one or more base apertures 148 (not all are numbered)—for releasing high-pressure, high-temperature fluid jets, as explained below. According to some embodiments, base apertures 148 also function as steam apertures. According to some embodiments, base 124 includes a dedicated steam aperture.

According to some embodiments, at least one of base apertures 148 includes threading and is thereby configured for affixing thereto a tube (not shown) including a screw portion at the bottom thereof (not shown), as elaborated hereinafter. The tube is configured for mounting thereon bottles and the like, including, baby bottles. The tube is hollow, and when mounted on one of at least one base apertures 148 is fluidly connected thereto. The tube includes a plurality of orifices along the length thereof configured to eject water towards the inner wall of bottles mounted thereon, the water being supplied via base apertures 148.

According to some embodiments, and as depicted in FIG. 1, cover 116 is a shutter 156. Shutter 156 is configured to be slid along a pair of shutter tracks 162: a shutter track 162*p* (shown in FIG. 6) and a shutter track 162*q*. According to some embodiments, shutter 156 includes a plurality of serially linked slats 164 (panels), similarly to a rolling shutter. Each of shutter tracks 162 includes a horizontal segment (shown in FIGS. 9-10*c*) and optionally a vertical segment (not shown). Each of the two horizontal segments is elongated, extending on a respective side from two opposite sides of a rim 166 of basin 112, i.e. on the tops of first wall 122*a* and third wall 122*c*, respectively. Each of the vertical segments extends below kitchen countertop 102. Sink 100 includes a narrow gap between the top of second wall 122*b* and kitchen countertop 102 where through shutter 156 is slid when switched to the first configuration from the second configuration and vice-versa. According to some embodiments, the top of second wall 122*b* has a rubber band (not shown) attached thereto (e.g. glued thereon). The rubber band wipes away fluids from the bottom surface of shutter 156 (essentially similarly to a windshield wiper except that the rubber band is stationary) when shutter 156 is opened after a washing cycle, thereby preventing wetting of the space below kitchen countertop 102. According to some embodiments, a rubber band is adhered on all sides of the narrow gap (including the top side of the narrow gap which is constituted by a strip on the bottom of kitchen countertop 102), being thereby configured to wipe away fluid(s) from the top surface of shutter as well, as further elaborated on below.

According to some embodiments, shutter 156 can be manually operated, e.g. manually opened and shut, in the absence of electric supply.

According to some embodiments, shutter 156 can be automatically operated, e.g. automatically opened and shut.

According to some embodiments, not depicted in the Figures, cover 116 is a hinged door, e.g. as in top-load dishwashers known in in the art.

According to some embodiments, not depicted in the Figures, shutter 156 is a rolling shutter, and sink 100 includes a spindle below kitchen countertop 102 and adjacent to second wall 122*b*. Shutter 156 is rolled about the spindle when in the first configuration.

According to some embodiments, faucet 106 includes a user control interface 172, e.g. a touch screen, allowing a user to control sink 100 dishwasher functionalities, e.g. to select and run a washing cycle program, as elaborated on below. According to some embodiments, the user control interface is embedded in/on kitchen countertop 102. According to some embodiments, the user control interface is provided by an external device of the user, such as a smartphone, with dedicated software (i.e. a custom app) installed thereon.

Figure 2:
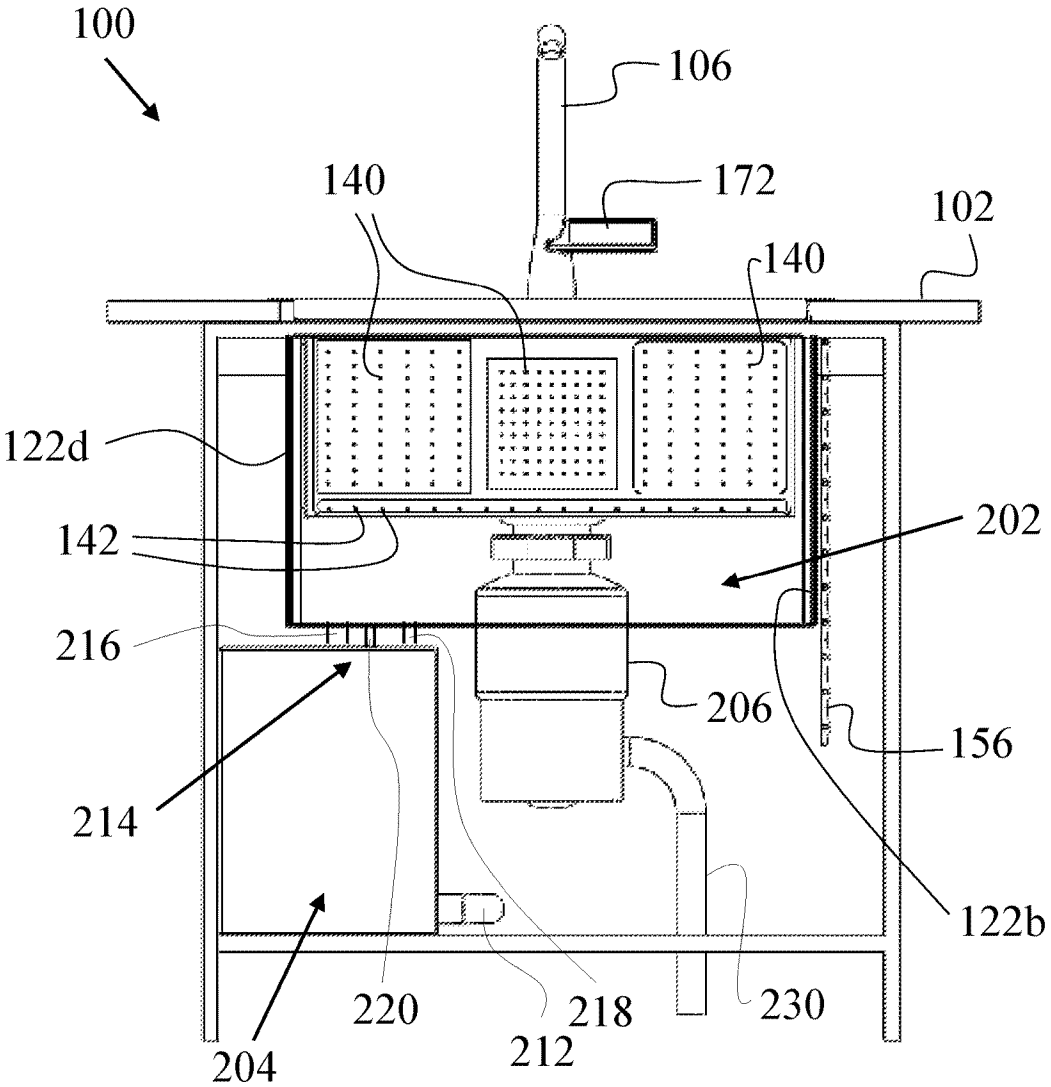
FIG. 2 provides a front view of the sink of FIG. 1 and infrastructure thereof, including an infrastructure container unit and a waste disposal unit, according to some embodiments.

FIG. 2 presents a front view of sink 100 with doors 108 omitted (i.e. not shown), according to some embodiments. Basin 112 further includes an infrastructure compartment 202 at the bottom thereof. Infrastructure compartment 202 houses some of sink 100 infrastructure (shown in FIG. 4). Sink 100 further includes an infrastructure container unit 204 including additional infrastructure of sink 100, as elaborated on below. According to some embodiments, sink 100 further includes a waste disposal unit 206 fluidly coupled to drain 134. According to some embodiments, a top portion of waste disposal unit 206 is housed within infrastructure compartment 202.

Components in infrastructure container unit 204 (e.g. valves and pumps) are controllably fluidly coupled to a (domestic) water installation (that is, an indoor plumbing system) via at least one water inlet pipe 212. Components in infrastructure container unit 204 are further controllably fluidly coupled to basin 112, particularly, to wall apertures 132 and base apertures 148 via outlet pipes 214. Outlet pipes 214 include a cold water pipe 216, controllably fluidly coupled at least to wall apertures 132, and a hot water pipe 218, controllably fluidly coupled to base apertures 148, and, according to some embodiments, to at least some of wall apertures 132. Outlet pipes 214 further include a steam pipe 220, controllably fluidly coupled to base apertures 148, and, according to some embodiments, to at least some of wall apertures 132. A drain pipe 230 fluidly couples drain 134 to the sewer. In embodiments including waste disposal unit 206, drain pipe 230 is fluidly connected to waste disposal unit 206.

As used herein, according to some embodiments, two elements are "fluidly coupled" when the two elements are in fluid communication with one another, either directly or by means of a third element, such as a pipe, leading from a first of the two elements to the second of the two elements.

As used herein, according to some embodiments, two elements are "controllably fluidly coupled" when the two elements can be switched (e.g. using a valve) from a first state, allowing fluid flow there between, to a second state, precluding fluid flow there between. In the first state, the two elements are in fluid communication with one another (either directly or e.g. via a pipe leading from the first element to the second element), such as to allow fluid to flow from one of the two elements to the other. In the second state, fluid cannot flow from either one of the two elements to the other.

The term "at least some" as used herein includes at least one or more.

Figure 3A:
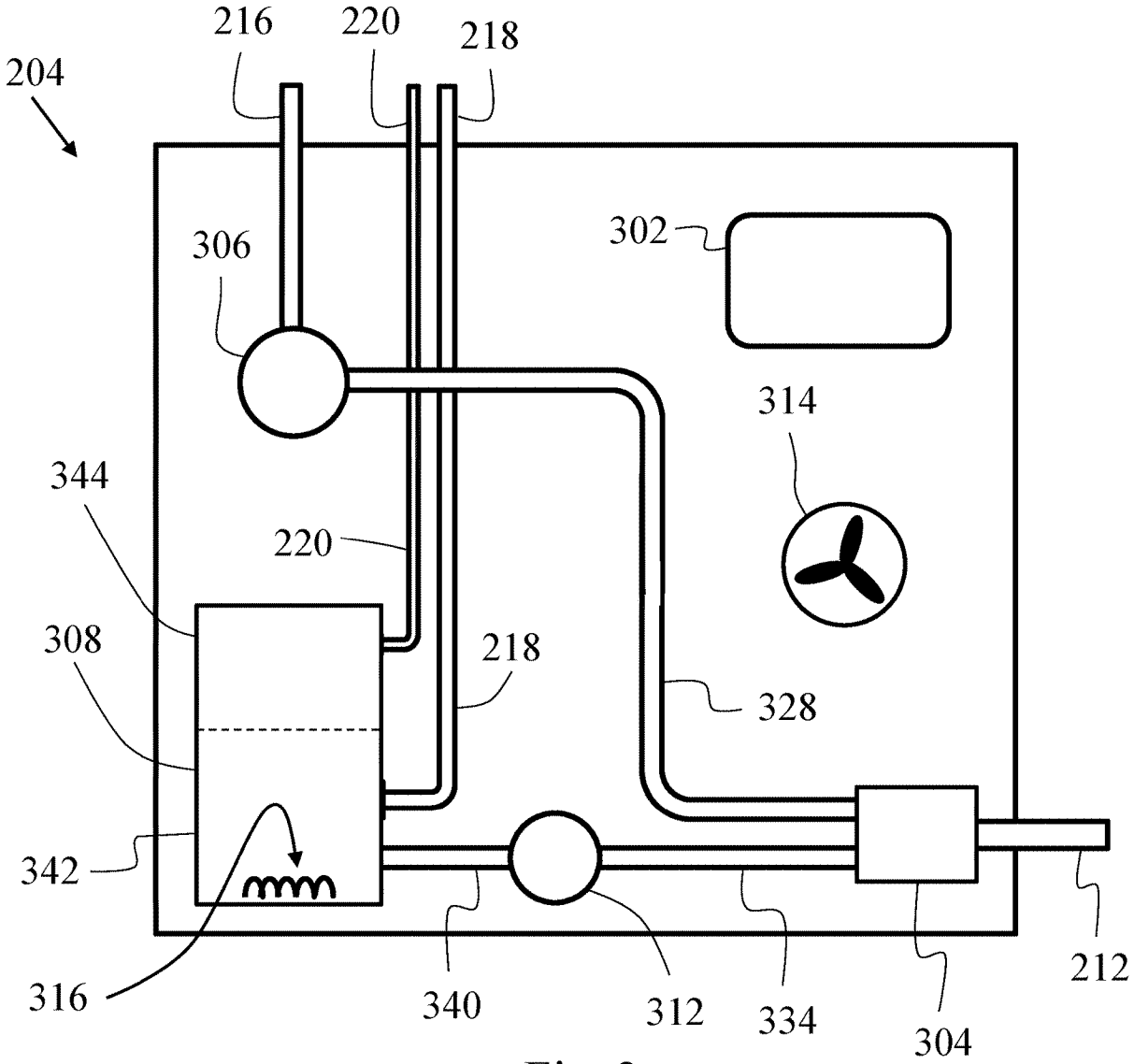
FIG. 3*a* provides a schematic view of the infrastructure container unit of FIG. 2, according to some embodiments.

FIG. 3*a* presents a schematic view of infrastructure within infrastructure container unit 204, according to some embodiments. Infrastructure container unit 204 includes a main controller 302, a three-way valve 304 (with one inlet port and two outlet ports), a water pump 306, a steam tank 308, and a second pump 312. Main controller 302 is an electronic control unit, as elaborated on below. Steam and high-pressure water tank 308 includes a heating element 316.

Three-way valve 304, water pump 306, steam tank 308, and second pump 312 are functionally associated with main controller 302, which controls and coordinates operation thereof, as elaborated on below. According to some embodiments, infrastructure container unit 204 further includes one or more fans 314 to prevent overheating of elements (also termed "components" herein) within infrastructure container unit 204, e.g. main controller 302, when sink 100 is running a washing cycle.

It is to be understood that the terms "steam tank", "high-pressure water tank" and "steam and high-pressure water tank" as used herein are interchangeable.

As used herein, according to some embodiments, a "n-way valve", where $n \geq 2$ is integer, refers to a valve whose combined number of inlet ports and outlet ports equals n.

Three-way valve 304 is controllably fluidly connected, via the inlet port (not numbered) thereof, to water inlet pipe 212. Three-way valve 304 is further controllably fluidly connected, via the two outlet ports (not numbered) thereof, to a first pipe 328 and to a second pipe 334. First pipe 328 is fluidly connected to water pump 306. Second pipe 334 is fluidly connected to second pump 312. A third pipe 340 leads out of second pump 312 to high-pressure water tank 308.

Three-way valve 304 is configured to allow fluidly decoupling infrastructure container unit 204 from the water installation (that is to say, fluidly decoupling components, such as water pump 306, steam tank 308, and second pump 312, from the water installation). Three-way valve 304 is further configured to allow fluidly coupling either of pumps 306 and 312 to the water installation or to simultaneously couple both of pumps 306 and 312 to the water installation and regulate the respective rates of water flow into each.

Generally, a three-way valve is configured to shut off water flow in a first pipe while opening water flow in a second pipe, to mix water from said pipes into a third pipe, or to separate water from one pipe into two different pipes. In some embodiments, three-way valve 304 is controlled by the main controller 302 for opening liquid flow to pipe 328 and to pipe 334 at the same time or separately.

Cold water pipe 216 extends from water pump 306 and leads to infrastructure compartment 202, thereby fluidly coupling water pump 306 to basin 112. Together with the water installation, water pump 306 functions as a pressurized fluid (cold water) source to wall apertures 132, as elaborated on below. Hot water pipe 218 extends from a tank bottom portion 342 of steam tank 308 and leads to infrastructure compartment 202, being thereby configured to supply hot water from steam tank 308 to basin 112. Together with the water installation, steam tank 308 functions as a pressurized fluid (hot water) source to base apertures 148, and optionally to wall apertures 132, as elaborated on below. Steam pipe 220 extends from a tank top portion 344 of steam tank 308 and leads to infrastructure compartment 202, being thereby configured to supply steam from steam tank 308 to basin 112, as elaborated on below.

According to some embodiments, the term "pressurized fluid source" refers to a fluid source and means for pressurizing the fluid, namely, a means bringing the pressure of the fluid to above atmospheric pressure. For example, a "pressurized fluid source" can be the domestic water installation, or a "pressurized fluid source" can be the combination of the domestic water installation and an external pump that further increases the pressure of the water provided by the domestic water installation.

Main controller 302 includes electronic components controlling and coordinating operation of three-way valve 304, water pump 306, steam tank 308, and second pump 312. In particular, three-way valve 304 may be an electronic (electro-mechanical, e.g. controlled by an electric current through a solenoid, as known in the art) or hydraulic valve. Main controller 302 may be functionally associated with three-way valve 304, water pump 306, steam tank 308, and second pump 312 via electrical wires (not shown), or even wirelessly (e.g. via Wi-Fi, Bluetooth, or near-field communication (NFC) transmitters/receivers/transceivers).

According to some embodiments, basin 112 includes base apertures 148 and water pump 306 is also controllably fluidly coupled to base apertures 148, such as to allow controllably ejecting cold water/fluid jets there through.

According to some embodiments, particularly embodiments wherein base 124 does not include base apertures 148, infrastructure container unit 204 does not include steam tank 308 and does not include second pump 312, and, instead of three-way valve 304, includes a two-way valve regulating supply of water from the water installation to water pump 306.

According to some embodiments, wherein sink 100 includes waste disposal unit 206, during a washing cycle, organic waste (food remains) from tableware and cookware is removed via drain 134 onto waste disposal unit 206, as further elaborated on below. According to some such embodiments, drain 134 is not sieved (at least not integrally formed with a filter), thereby allowing disposal there through of sizable organic waste, including hard organic waste such as chicken bones.

According to some embodiments, drain 134 has a larger diameter than typical of a standard (non-dishwasher) kitchen sink, thereby expediting expulsion of fluid—and optionally organic waste, particularly in embodiments, wherein sink 100 includes waste disposal unit 206—from basin 112 during a washing cycle. The drain (drain hole) of a standard kitchen sink is about 9 cm in diameter.

According to some embodiments, base 124 is centrally inclined around drain 134 such that the inclination angle is greater than that of a standard sink, thereby expediting drainage of fluids in basin 112, e.g. during a washing cycle. According to some embodiments, drain 134 is fluidly coupled to a drain pump (not shown) to expedite drainage of fluids in basin 112. According to some embodiments, base 124 includes extra drain-holes (beyond drain 134; not shown), which can be controllably opened (and thereby controllably fluidly coupled to drain pipe 230) during a washing cycle to expedite drainage of fluid from basin 112.

According to some embodiments, water pump 306 is configured to receive water both from the cold water installation and the hot water installation. A valve allows controllably selecting between cold and hot water, or adjusting the proportion of cold to hot water entering water pump 306, thereby controlling the temperature of the water pumped out of water pump 306.

Figure 3B:
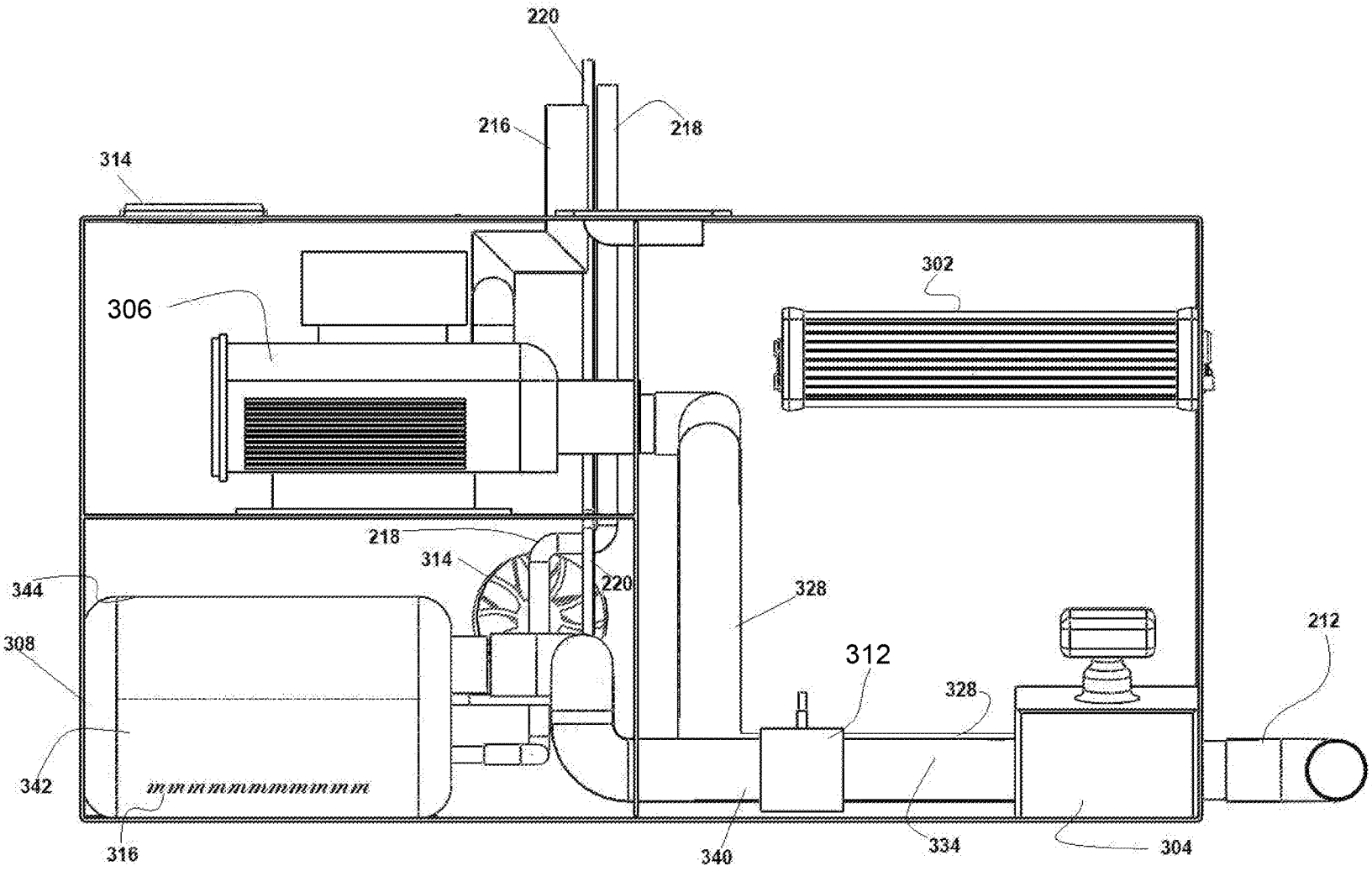
FIG. 3*b* provides a side view of the infrastructure container unit of FIG. 2, according to some embodiments.

FIG. 3*b* presents side view of infrastructure container unit 204 according to some embodiments.

Figure 4A:
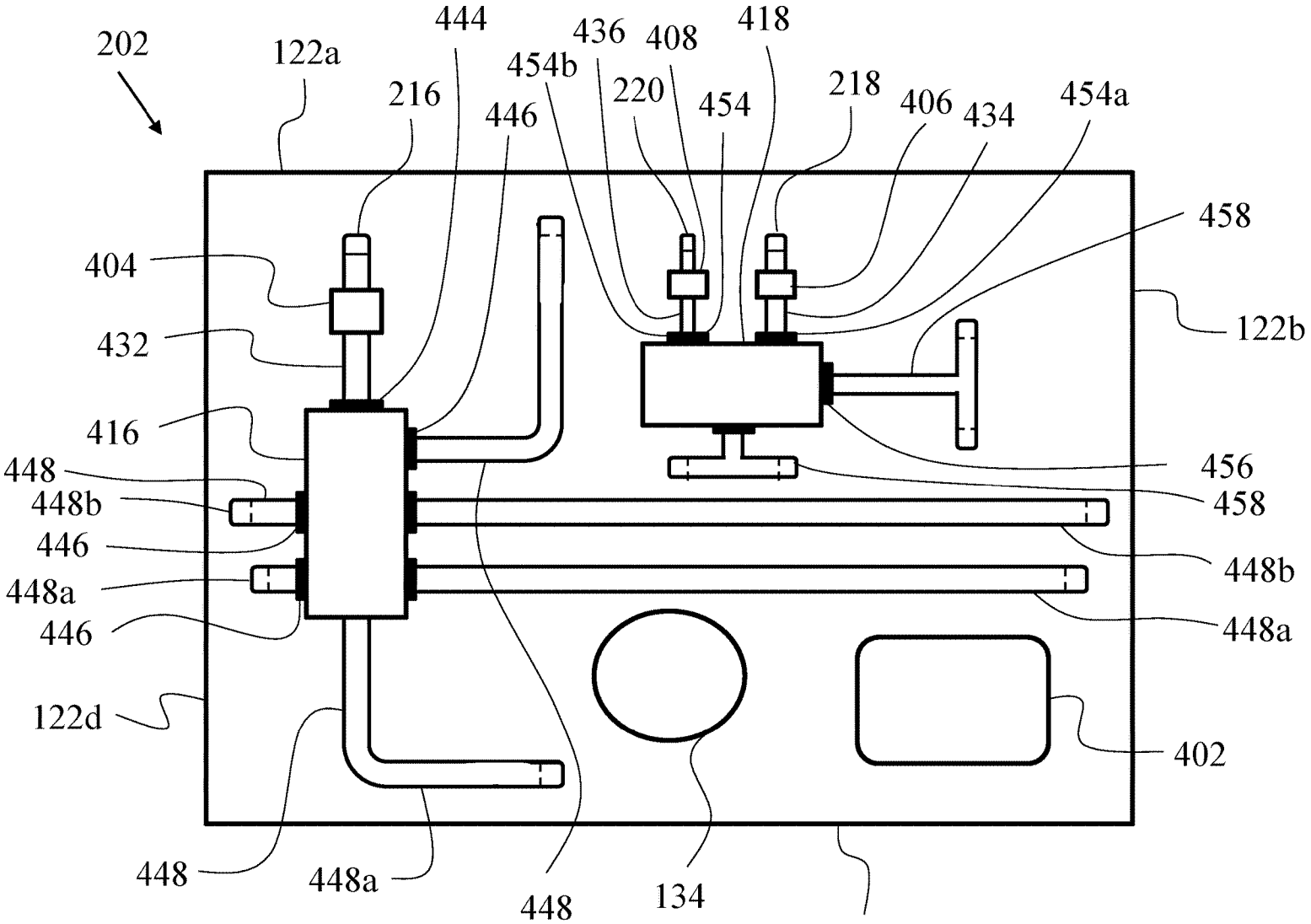
FIG. 4*a* provides a schematic view of an infrastructure compartment located at the bottom of a basin of the sink of FIG. 1, according to some embodiments.

FIG. 4*a* presents a bottom view of infrastructure compartment 202 with the bottom surface thereof removed (not shown). Waste disposal unit 206 is also not shown. Infrastructure compartment 202 includes a secondary controller 402, a cold water valve 404, a hot water valve 406, and a steam valve 408. Infrastructure compartment 202 further includes a first multi-way valve 416 and a second multi-way valve 418.

According to some embodiments, valves 404, 406, and 408, and multi-way valves 416 and 418 are electronic (i.e. are operated by signals, e.g. electrical signals, received from secondary controller 402). Secondary controller 402 includes electronic components controlling and coordinating operation the valves and multi-way valves. In particular, secondary controller 402 regulates the opening and closing times of the inlet ports and outlet ports of valves 404, 406, and 408, and multi-way valves 416 and 418. Secondary controller may be functionally associated with valves 404, 406, and 408, and multi-way valves 416 and 418 via electrical wires (not shown), or even wirelessly (e.g. via NFC transmitters/receivers/transceivers).

Secondary controller 402 is communicatively associated (via electrical wires or wirelessly) with main controller 302, which controls operation of secondary controller 402, as elaborated on below.

Cold water valve 404 is connected on the inlet port (not numbered) thereof to cold water pipe 216, and is controllably fluidly coupled via the outlet port (not numbered) thereof, and a pipe 432, to first multi-way valve 416. According to some embodiments, cold water valve 404 is an on/off valve. According to some embodiments, cold water valve 404 is a control valve controlling flow (including the flow rate) of cold water from water pump 306 to first multi-way valve 416.

Hot water valve 406 is connected on the inlet port (not numbered) thereof to hot water pipe 218, and is controllably fluidly coupled via the outlet port (not numbered) thereof, and a pipe 434, to second multi-way valve 418. According to some embodiments, hot water valve 406 is an on/off valve. According to some embodiments, hot water valve 406 is a control valve controlling flow (including the flow rate) of hot water from steam tank 308 to second multi-way valve 418.

Steam valve 408 is connected on the inlet port (not numbered) thereof to steam pipe 220, and is controllably fluidly coupled via the outlet port (not numbered) thereof, and a pipe 436, to second multi-way valve 418. According to some embodiments, steam valve 408 is an on/off valve. According to some embodiments, steam valve 406 is a control valve controlling flow (including the flow rate) of steam from steam tank 308 to second multi-way valve 418.

First multi-way valve 416 includes an inlet port 444, which is connected to pipe 432, and a plurality of outlet ports 446 (not all of which are numbered).

Outlet ports 446 are controllably fluidly coupled via first outlet pipes 448 to different aperture groups (i.e. groups of apertures) from wall apertures 132, respectively, thereby allowing to control and regulate fluid flow to the different aperture groups (each one of first outlet pipes 448 being coupled to a respective aperture group), as elaborated on below. In particular, first outlet pipes 448*a* (from first outlet pipes 448) lead to different aperture groups from first set of apertures 140, and first outlet pipes 448*b* (from first outlet pipes 448) lead to different aperture groups from second set of apertures 142.

Second multi-way valve 418 includes two inlet ports 454 and a plurality of outlet ports 456 (not all of which are numbered). A first of inlet ports 454, a first inlet port 454*a*, is connected to pipe 434. The second of inlet ports 454, a second inlet port 454*b*, is connected to pipe 436.

Outlet ports 456 are controllably fluidly coupled via second outlet pipes 458 to different aperture groups from base apertures 148, and according to some embodiments not shown in FIG. 4*a*, to different aperture groups from wall apertures 132, respectively, thereby allowing to control and regulate fluid flow to the different aperture groups (each one of second outlet pipes 458 being coupled to a respective aperture group), as elaborated on below.

As used herein, according to some embodiments, the term "aperture group" can also refer to a single aperture.

According to some embodiments, at least some of the above-described valves may be pneumatic, not being controlled by main controller 302 or secondary controller 402. In particular, steam valve 408, which governs the supply of steam into basin 112 during a washing cycle, may be pneumatic.

Figure 4B:
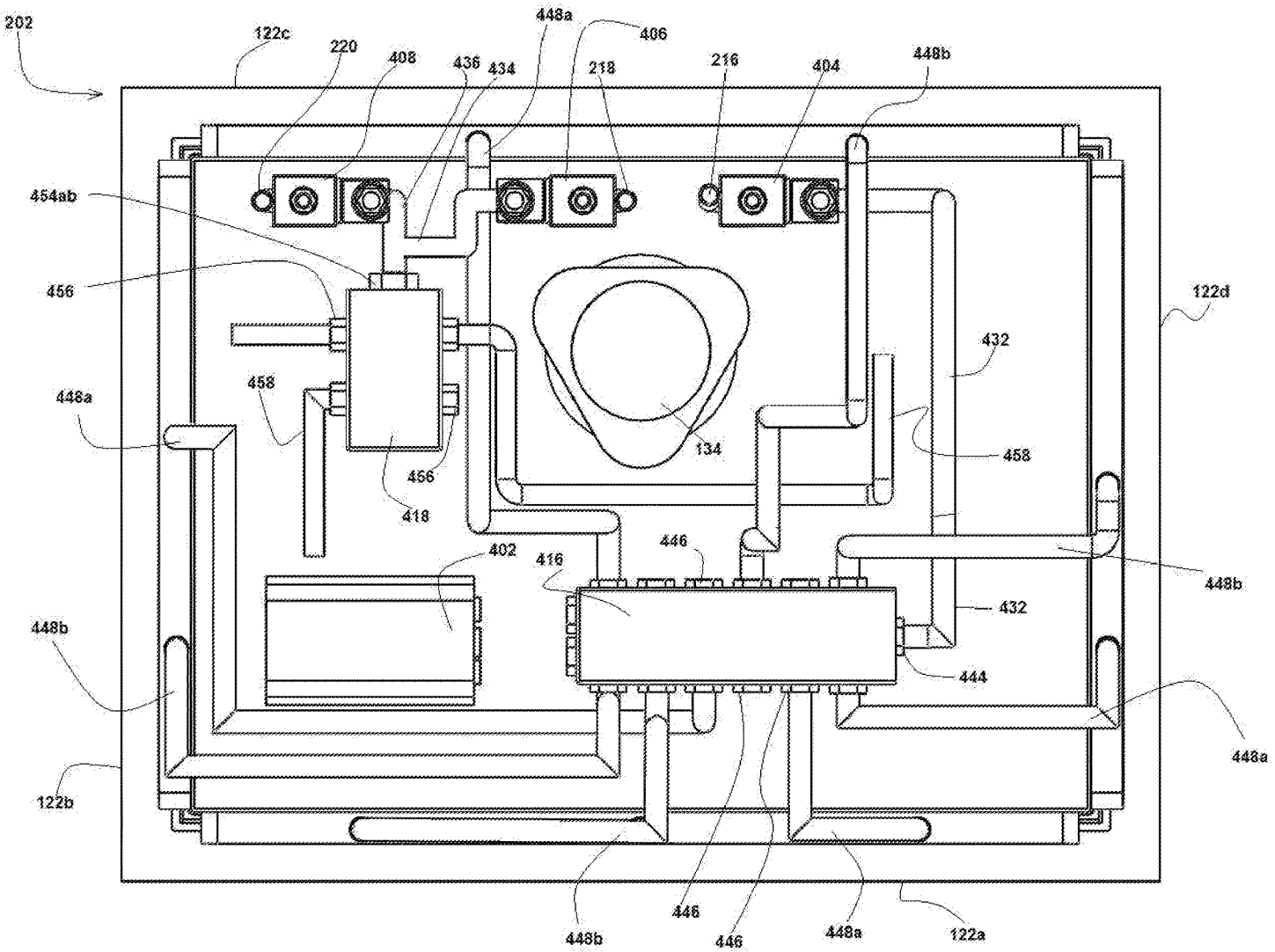
FIG. 4*b* provides a bottom view of an infrastructure compartment located at the bottom of a basin of the sink of FIG. 1, according to some embodiments.

FIG. 4*b* presents bottom view of infrastructure compartment 202 according to some embodiments. According to some embodiments, the inlet and outlet ports of multi-way valves 416 and 418 include fastening units, such as nuts, clamps, couplings, grommets, and washers. According to some embodiments, second multi-way valve 418 includes a single inlet port 454*ab* and pipe 434 and pipe 436 are both (alternately) controllably fluidly connected thereto.

Figure 5:
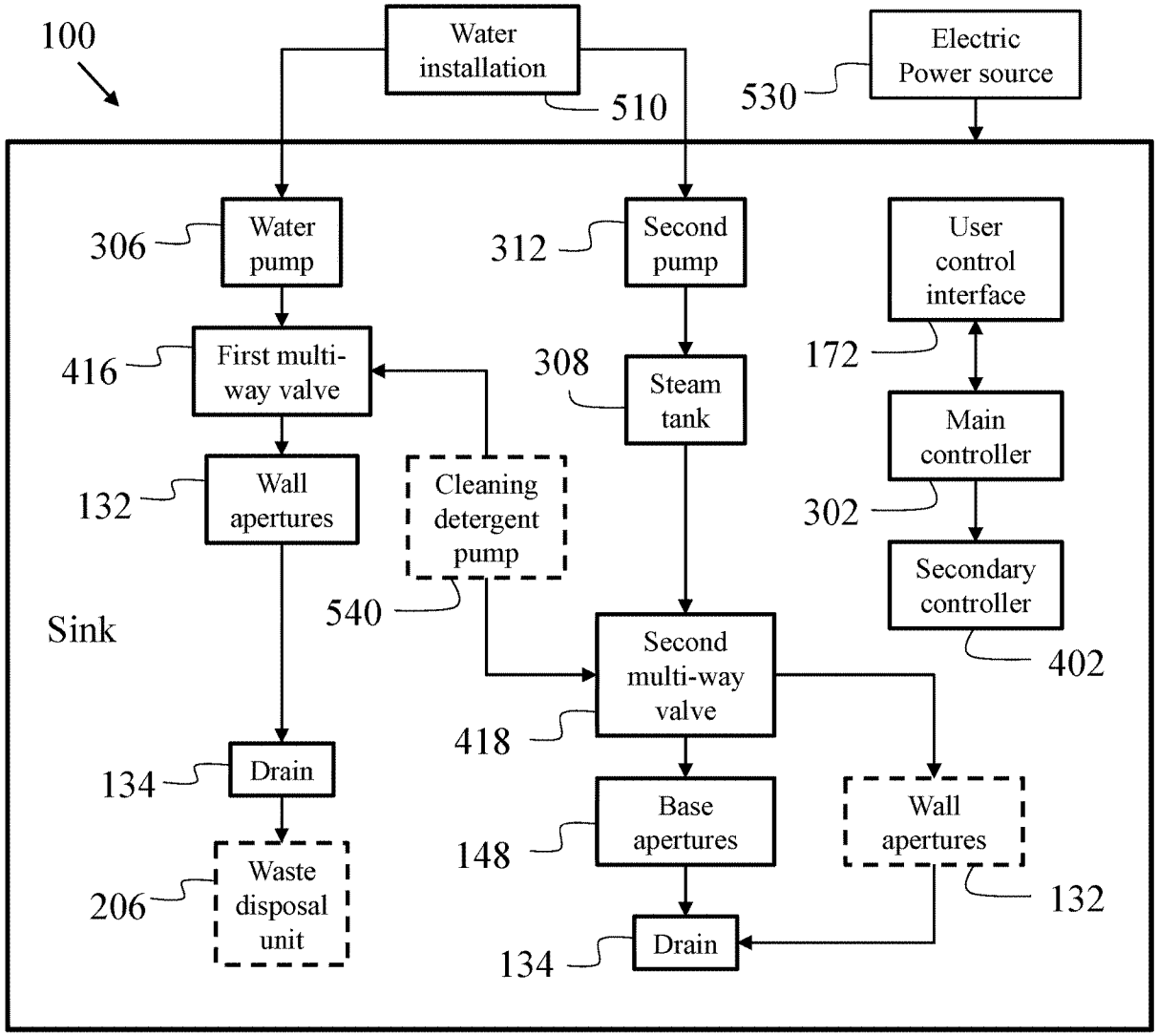
FIG. 5 is system diagram of the sink of FIG. 1, according to some embodiments.

FIG. 5 is a system diagram of sink 100, according to some embodiments. Main controller 302 controls operation of sink 100 when used as a dishwasher, as elaborated on below. More specifically, main controller 302 is configured to initiate, halt, regulate, and coordinate operations of the various components involved in implementing a washing cycle. In particular, main controller 302, via three-way valve 304, regulates water supply from a water installation 510 to water pump 306 and to steam tank 308 and the respective flows of cold water, and hot water and steam, respectively, therefrom to infrastructure compartment 202.

Main controller 302 includes electronic circuitry (not shown) configured to: communicate the choice of washing cycle program (or in some embodiments to communicate washing cycle program instructions in real-time during washing cycle) to secondary controller 402; control and regulate flow of cold water through three-way valve 304 to water pump 306 and steam tank 308; apply a voltage across heating element 316 in steam tank 308 thereby heating water therein; open/close and lock/unlock shutter 156; and so on.

Secondary controller 402 includes electronic circuitry (not shown) configured to: receive the choice of washing cycle program (or in some embodiments to receive washing cycle program instructions in real-time during the washing cycle) from main controller 302 and accordingly control, distribute, and regulate flow of cold water through outlet ports 446 of first multi-way valve 416 onto wall apertures 132; accordingly control, distribute, and regulate flow of hot water and steam through outlet ports 456 of second multi-way valve 418 onto base apertures 148 and optionally wall apertures 132; and so on.

According to some embodiments, main controller 302 and secondary controller 402 are configured to allow running different washing programs: e.g. a short washing cycle, using cold or lukewarm water, for slightly soiled tableware; a long washing cycle, using hot water, for highly soiled tableware and cookware; a small load washing program wherein tableware is placed in a region constituting, for example, one third of basin 112, which is selectively targeted by water jets from respective subsets of wall apertures 132, as elaborated on below.

As used herein, the term "electronic circuitry" refers to electrical wires, conductors (either discrete wires or printed circuits), capacitors, inductors, as well as electronic components per se, either solid state or otherwise, such as diodes, transistors, amplifiers, A/D convertors (e.g. to convert an analog voltage signal from a thermometer in basin 112 or steam tank 308 to a digital temperature reading), timer circuits, or any combination thereof. In particular, the term "electronic circuitry" is used in a broad sense and is intended to encompass main controller 302 components and secondary controller 402 components (for example, hardware and/or software) configured to process data, e.g. from sensors or from user control interface 172 as elaborated on below, to control functionality of sink 100 when used as a dishwasher. According to some such embodiments, main controller 302 and secondary controller 402 include processing circuitry and memory circuitry.

To keep the Figures simple and clear, electrical wires connecting functionally associated components to one another, or supplying power from the home electrical system, are not depicted.

Main controller 302 is communicatively associated with user control interface 172. According to some embodiments, main controller 302 contains a wireless communication unit (e.g. a Wi-Fi, Bluetooth, and/or near-field communication (NFC) transceiver, not shown) and can be controlled via an external device such as a smartphone.

Sink 100 is powered through an electric power source 530 (e.g. the home electrical system). In particular, electric power source 530 provides power to water pump 306, and to waste disposal unit 206 and/or steam tank 308 and second pump 312, in embodiments including waste disposal unit 206 and/or steam tank 308. Electric power source 530 further provides power to operate the valves and multi-way valves in infrastructure container unit 204 and infrastructure compartment 202.

According to some exemplary embodiments, steam tank 308 has a capacity between 2 to 12 liters. According to some exemplary embodiments, steam tank 308 has a capacity between 3 and 10 liters. According to some exemplary embodiments, steam tank 308 has a capacity of about 8 liters.

According to some exemplary embodiments, second pump 312 is able to supply water into steam tank 308 at a pressure as high as about 7 bars or even as high as 10 bars. According to some embodiments, water within steam tank 308 is heated to a temperature as high as 120° C. and released as steam into basin 112 at a pressure of about 20 bars.

It will be understood that the infrastructure components, such as water pump 306 and steam tank 308, which are described above as being housed within infrastructure container unit 204, may be directly installed beneath kitchen countertop 102 without being housed within any container (such as infrastructure container unit 204), and the scope of the disclosed technology covers this option. One of the advantages offered by the housing of these infrastructure components within a single container is ease of installation. The infrastructure components within infrastructure container unit 204 arrive pre-installed in the sense that when installing sink 100, infrastructure container unit 204 has to be connected to the water installation (by means of water inlet pipe 212) and to basin 112 (by means of outlet pipes 214), but is otherwise already set-up in the sense no action is required by the technician to connect/couple the infrastructure components within infrastructure container unit 204 to one another.

Similarly, infrastructure components within infrastructure compartment 202, such as first multi-way valve 416 and second multi-way valve 418, may arrive pre-installed in the sense of already being coupled to e.g. wall apertures 132 and base apertures 148, respectively.

According to some embodiments, hot water pipe 218 is coupled to a cleaning detergent pump 540, which is configured to controllably introduce cleaning detergent into hot water pipe 218. Cleaning detergent 540 pump may be located in infrastructure compartment 202 or in infrastructure container unit 204 and the operation thereof controlled by main controller 302 or secondary controller 402, respectively. Cleaning detergent pump 540 may be fluidly coupled to a replaceable/refillable cleaning detergent tank (not shown) located beneath kitchen countertop 102, which allows for multiple washing cycle runs before having to be replaced/refilled.

Additionally or alternatively, cold water pipe 216 may be coupled to a cleaning detergent pump, essentially as described above with respect to hot water pipe 218. According to some embodiments, hot water pipe 218 and cold water pipe 216 are switchably coupled to cleaning detergent pump 540.

According to some embodiments, cold water pipe 216 and/or hot water pipe 218 include a salt filter (not shown) for releasing salt into water (or fluids) flowing there through.

Figure 6:
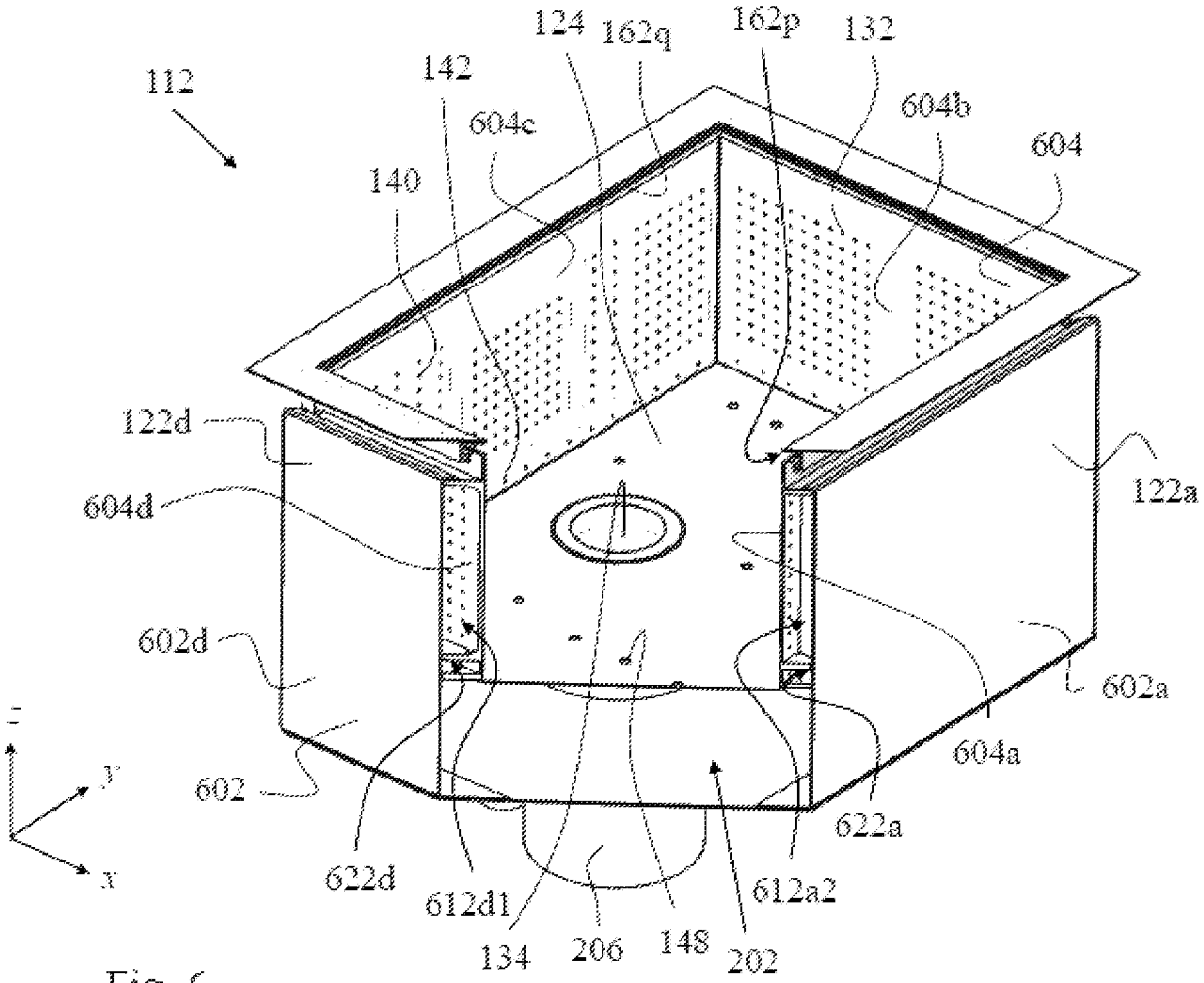
FIG. 6 provides a perspective cutaway view of the basin of the sink of FIG. 1, wherein the basin is double-walled, according to some embodiments.

FIG. 6 provides a perspective cutaway view of basin 112, according to some embodiments thereof wherein basin 112 is double-walled. Basin 112 includes outer walls 602 and inner walls 604—partially revealed in FIG. 6 by the cut. Outer walls 602 and inner walls 604 define there between a plurality of inner chambers 612, as elaborated on below. Outer walls 602 include a first outer wall 602*a*, a second outer wall (hidden from view in FIG. 6) at right angles to first outer wall 602*a*, a third outer wall (hidden from view in FIG. 6) opposite (and parallel to) first outer wall 602*a*, and a fourth outer wall 602*d* opposite (and parallel to) the second outer wall.

According to some embodiments, the double-wall structure of basin 112 is configured for improved acoustics during a washing cycle.

It will be understood that in embodiments wherein basin 112 is double-walled, walls 122 refer to the totality of outer walls 602 and inner walls 604, e.g. first wall 122*a* will be understood to include both first outer wall 602*a* and first inner wall 604*a*.

Figure 7A:
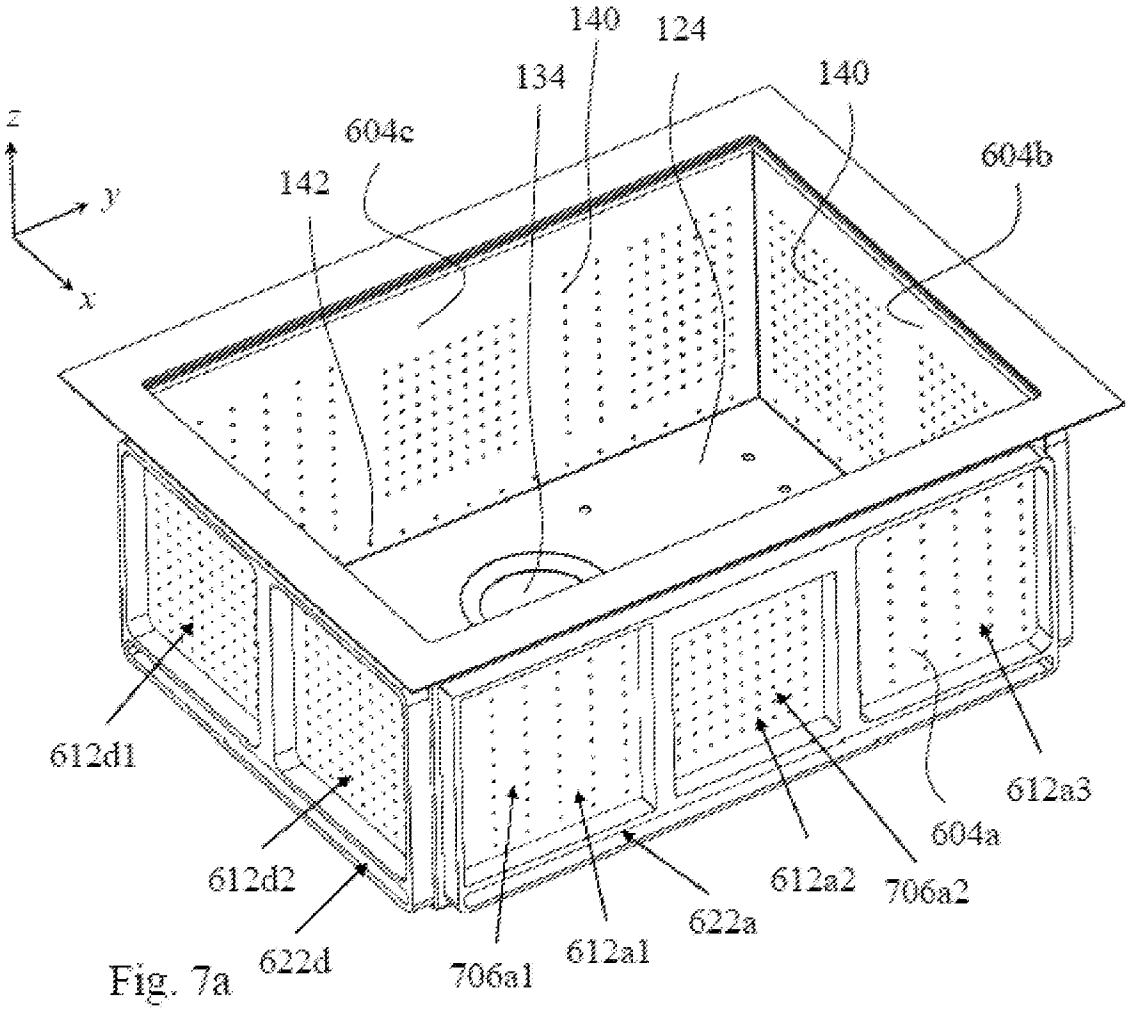
FIG. 7*a* provides a perspective top view of the basin of FIG. 6, according to some embodiments.
Figure 7B:
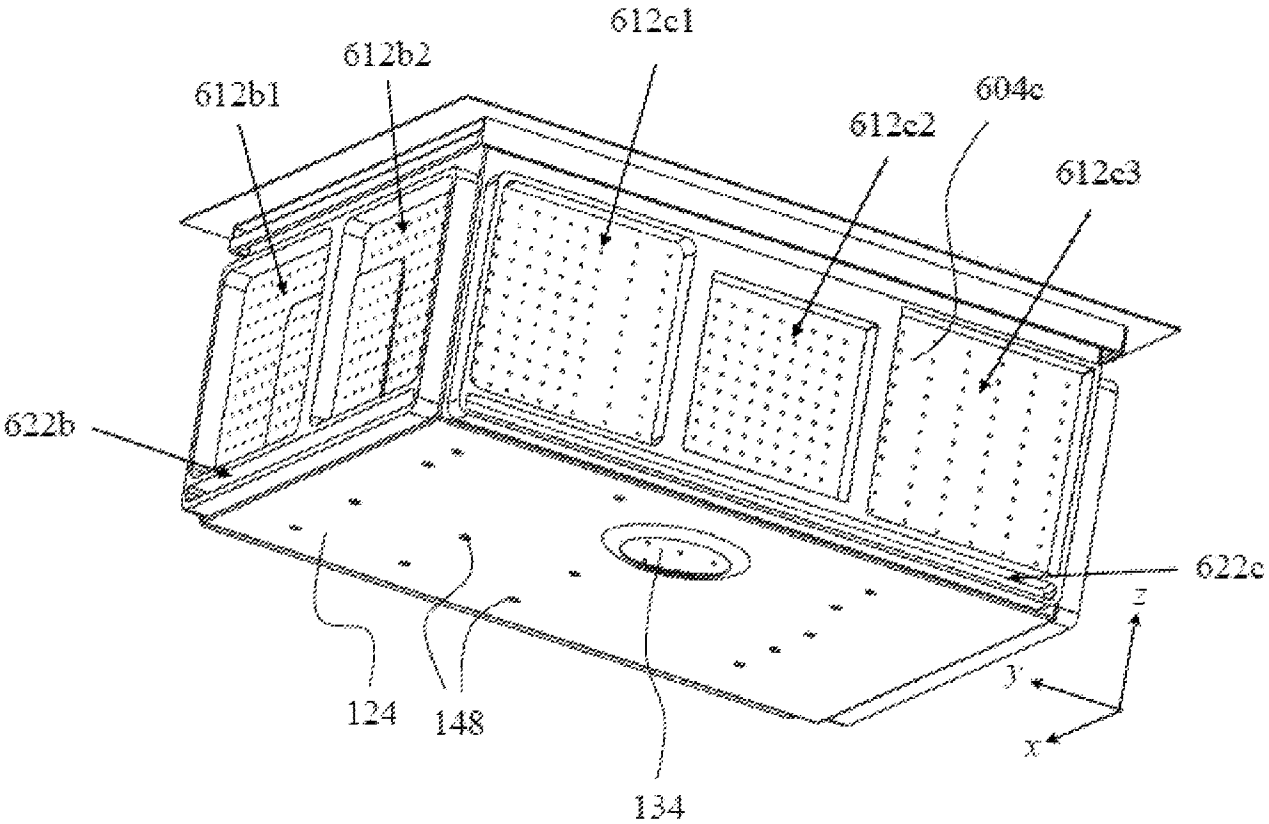
FIG. 7*b* provides a perspective bottom view of the basin of FIG. 6, according to some embodiments.

Making reference also to FIGS. 7*a*-7*b*, these figures provide a perspective view from above and below, respectively, of basin 112 omitting outer walls 602 and infrastructure compartment 202 (i.e. outer walls 602 and infrastructure compartment 202 are not shown). Inner walls 604 include a first inner wall 604*a*, a second inner wall 604*b* at right angles (perpendicular) to first inner wall 604*a*, a third inner wall 604*c* opposite (and parallel to) first inner wall 604*a*, and a fourth inner wall 604*d* opposite (and parallel to) second inner wall 604*b*. According to some embodiments, and as depicted in FIGS. 7*a*-7*b*, each pair of outer and inner walls, e.g. first outer wall 602*a* and first inner wall 604*a*, defines there between at least one inner chamber (from inner chambers 612). Each of inner chambers 612 extends along two peripheral directions, e.g. an inner chamber 612*a*2, defined by first outer wall 602*a* and first inner wall 604*a*, extends along the y and z directions, while inner chamber 612*d*1, defined by fourth outer wall 602*d* and fourth inner wall 604*d*, extends along the z and x directions.

Each of inner chambers 612 may be connected to a respective pipe from first outlet pipes 448*a*. According to some such embodiments, secondary controller 402 and first multi-way valve 416 are configured such as to allow supplying water to only one of inner chambers 612 at a time, or only two of inner chambers 612 at a time, so that water jets are ejected (sprayed, spouted) through only one of inner chambers 612 at a time, or through only two of inner chambers 612 at a time.

As used herein, according to some embodiments, the term "fluid/water jet" refers to a forcible and directed discharge (e.g. along a direction) of fluid/water.

According to some exemplary embodiments, and as depicted in FIG. 6 and FIGS. 7*a*-7*c*, inner chambers 612 number ten inner chambers: three inner chambers, an inner chamber 612*a*1, inner chamber 612*a*2, and an inner chamber 612*a*3 (such that inner chamber 612*a*2 is adjacent to both inner chamber 612*a*1 and inner chamber 612*a*3), are defined by first outer wall 602*a* and first inner wall 604*a*; two adjacent inner chambers, inner chamber 612*b*1 and an inner chamber 612*b*2, are defined by the second outer wall and second inner wall 604*b*; three inner chambers, an inner chamber 612*c*1, an inner chamber 612*c*2, and an inner chamber 612*c*3 (such that inner chamber 612*c*2 is adjacent to both inner chamber 612*c*1 and inner chamber 612*c*3), are defined by the third outer wall and third inner wall 604*c*; and two adjacent inner chambers, inner chamber 612*d*1 and an inner chamber 612*d*2, are defined by fourth outer wall 602*d* and fourth inner wall 604*d*.

Inner chambers 612*a*1 and 612*c*3 are opposite one another, as are inner chambers 612*a*2 and 612*c*2, and inner chambers 612*a*3 and 612*c*1. Similarly, inner chambers 612*b*1 and 612*d*2 are opposite one another, as are inner chambers 612*b*2 and 612*d*1.

In some exemplary washing cycle programs, water jets may be ejected (discharged) sequentially in a rotating pattern. For example, water jets may be ejected in an anti-clock wise pattern, from one chamber at a time starting with inner chamber 612*a*1, followed by inner chamber 612*a*2, followed by inner chamber 612*a*3, followed by inner chamber 612*b*1, and so on; the pattern being completed with the ejection of water jets from inner chamber 612*d*2. According to some embodiments, the duration of the water jets ejection from each of inner chambers 612 is five (5) seconds, so that the pattern of water jets ejection is completed in one minutes. The water ejection pattern may then be repeated, e.g. two, three, or even ten times. According to some embodiments, the pressure of each of the ejected water jets is between about 10 to about 20 bar.

According to some embodiments, basin 112 includes at least two horizontal channels 622 on two opposite sides on the bottom thereof. For example, and as depicted in FIG. 6 and FIGS. 7*a*-7*c*, each pair of outer and inner walls (e.g. first outer wall 602*a* and first inner wall 604*a*) defines a respective horizontal channel there between below the inner chambers defined by the pair of walls. A first channel 622*a* extends between first outer wall 602*a* and first inner wall 604*a* below inner chambers 612*a*1, 612*a*2, and 612*a*3. Similarly, a second channel 622*b* extends between the second outer wall and second inner wall 604*b*, below inner chambers 612*b*1 and 612*b*2, a third channel 622*c* extends between the third outer wall and third inner wall 604*c* below inner chambers 612*c*1, 612*c*2, and 612*c*3, and a fourth channel 622*d* extends between fourth outer wall 602*d* and fourth inner wall 604*d* below inner chambers 612*d*1 and 612*d*2.

According to some embodiments, basin 112 includes only two channel horizontal channels, e.g. second channel 622*b* and fourth channel 622*d*.

According to some embodiments, apertures from first set of apertures 140 are located on the inner walls of inner chambers 612 and apertures from second set of apertures 142 are located on inner horizontal strips defined by channels 622 (e.g. the part of first channel 622*a* coinciding with first inner wall 604*a*). According to some embodiments, the terms "first set of apertures" and "chamber apertures" are used interchangeably. According to some embodiments, the terms "second set of apertures" and "channel apertures" are used interchangeably.

Each of channels 622 may be connected to a respective pipe from first outlet pipes 448*b*. According to some embodiments, apertures in second set of apertures 142 are located between about 0.5 cm to about 3 cm above base 124. According to some embodiments, apertures in second set of apertures 142 are located between about 1 cm to about 2 cm above base 124.

According to some embodiments, wherein the apertures in second set of apertures 142 are located proximately to base 124 and wherein water jets ejected from the apertures in second set of apertures 142 are ejected substantially in parallel to the xy plane, the water jets hit waste (e.g. food waste) located on base 124. As a result, water jets ejected from second set of apertures 142 function to direct (guide) waste (e.g. food waste) into drain 134, and therefrom into waste disposal unit 206, wherein the waste is shredded. According to some embodiments, to direct (guide) food waste into drain 134 water jets are simultaneously ejected from a pair of opposite channels (e.g. second channel 622*b* and fourth channel 622*d*), or even from all of the channels.

According to some embodiments, water jets ejected from second set of apertures 142 may be of higher pressure than water jets ejected from first set of apertures 140.

According to some embodiments, the number of apertures defined by a channel, e.g. channel 622*b*, may number 3 to 10, each having a diameter of about 1 to 3 mm. According to some embodiments, the number of apertures defined by one of inner chambers 612 may range from about 50 to about 150 (as in some embodiments of chamber 612*c*3 and 612*b*1. Accordingly, due to the smaller number of apertures in each of channels 622 as compared to number of apertures in each of inner chambers 612, channels 622 are configured for ejection of stronger (more highly pressurized) water jets than inner chambers 612. In particular, channel 622 are configured to allow for ejection of sufficiently strong fluid jets to direct sizable food-waste on base 124, or food-waste stuck onto base 124, onto drain 134.

As used herein, according to some embodiments, the term "channel" refers to a confined elongated space. That is to say, a closed space such that one of the characterizing dimensions thereof, e.g. the length thereof, is substantially greater than any one of the two other dimensions thereof. According to some embodiments, a channel has a length which is more than five times as a large as the width and thickness thereof. According to some embodiments, a channel has a length which is more than four times as a large as the width and thickness thereof. According to some embodiments, a channel has a length which is more than three times as a large as the width and thickness thereof. In contrast, according to some embodiments, the term "chamber", as in "inner chamber", refers to a closed space which is not a channel, in particular a closed space such that at least two of the characterizing dimensions thereof are comparable.

Figure 7C:
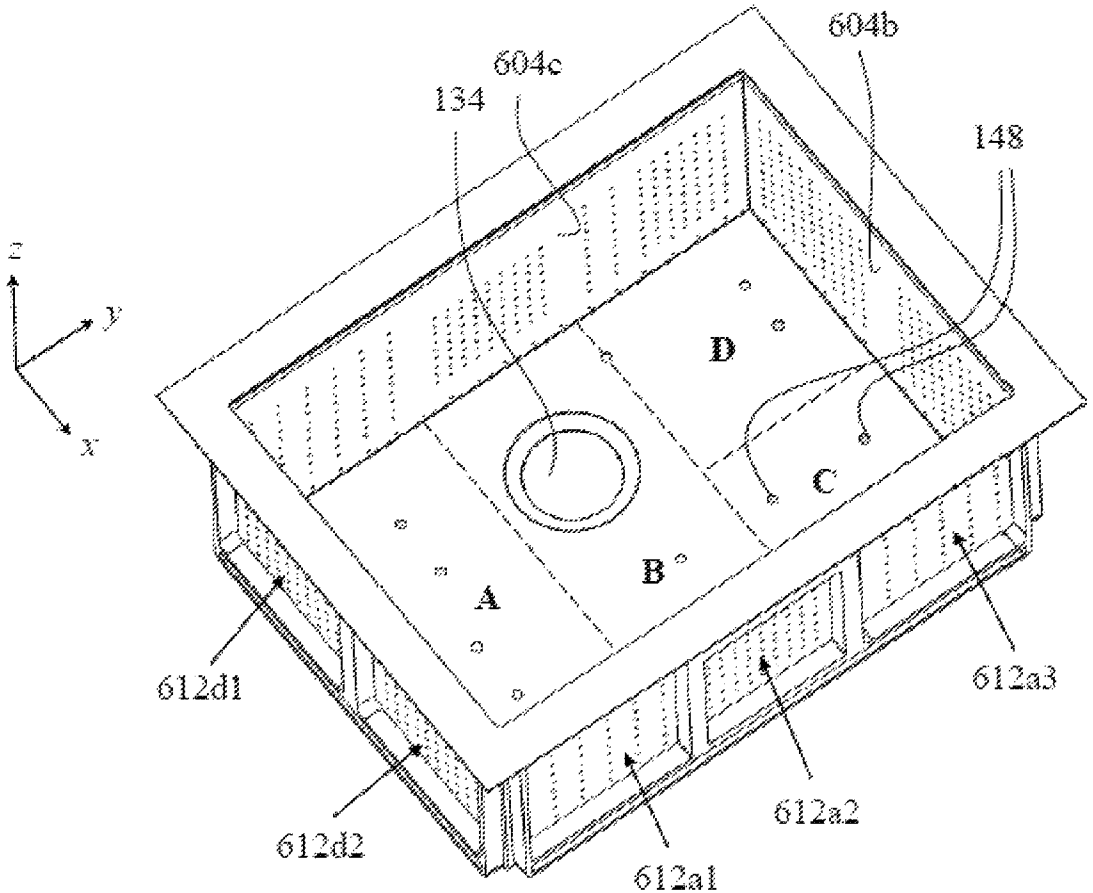
FIG. 7*c* provides a perspective top view of the basin of FIG. 6 with regions for washing different types of tableware and cookware, indicated, according to some embodiments.

According to some embodiments, different regions within basin 112 are configured for washing different types of tableware and/or cookware. Accordingly, in such embodiments, wall apertures 132 define different aperture patterns on the inner walls of different inner chambers. For example, and as depicted in FIGS. 6-7*c*, a pattern of apertures 706*a*2 on the inner wall of inner chamber 612*a*2 is more dense than a pattern of apertures 706*a*1 on the inner wall of inner chamber 612*a*1. According to some embodiments, the less dense the pattern of apertures, the stronger the fluid jets ejected through the apertures. Thus, tableware and cookware which require higher-pressured fluid jets for the cleaning thereof may be placed proximately to inner walls having a less dense pattern of apertures, as elaborated on below. The apertures on the inner walls of different chambers may also differ in diameter from one another, so as to produce the respective fluid jets at desired pressures.

Making reference to FIG. 7*c*, which depicts a perspective top view of basin 112, omitting outer walls 602 and infrastructure compartment 202 (i.e. outer walls 602 and compartment 202 are not shown). Basin 112 defines four regions for washing different types of tableware and cookware, respectively: a first region A, a second region B, a third region C, and a fourth region D. First region A is bordered by fourth inner wall 604*d*, the inner walls of inner chambers 612*a*1 and 612*c*3, and second region B. Second region B is bordered by first region A, the inner walls of inner chamber 612*a*2 and 612*c*2, and regions C and D. Third region C is bordered by the inner walls of inner chambers 612*a*3 and 612*b*1, and regions B and D. Fourth region D is bordered by inner chambers 612*b*2 and 612*c*1, and regions B and C. First region A is intended for dishes (e.g. plates) and pans. Second region B is intended for bowls and pots. Third region C is intended for glasses and cups. Fourth region D is intended for cutlery and kitchen utensils.

According to some embodiments, region A is also configured to allow washing tableware and cookware other than plates, for example, bowls, cups and cutlery.

According to some embodiments, region B is also configured to allow washing tableware and cookware other than bowls and pots, for example, cups and glasses.

According to some embodiments, region C is also configured to allow washing tableware and cookware other than cups and glasses, for example, bowls and pots.

According to some embodiments, region D is also configured to allow washing tableware and cookware other than cutlery, for example, cups and small bowls.

According to some embodiments, wherein base 124 includes base apertures 148, at least some of base apertures 148 are located in third region C, being configured for washing of glasses and cups, as elaborated on below.

According to some embodiments, basin 112 is not fully double-walled in the sense that some portions of walls 122 are hollow (that is to say, doubled-walled, such as to define an inner chamber between the walls, e.g. inner chamber 612*a*2, which is defined on a central portion of first wall 122*a*), and some portions of walls 122 are solid in the sense of not being hollow.

For example, according to some embodiments, walls 122*a* and 122*c* are double-walled and walls 122*b* and 122*d* are not.

According to some embodiments, at least a portion of base 124 is double-walled such as to constitute an inner chamber (not shown), similarly to inner chamber 612 having a similar function thereto.

Figure 8:
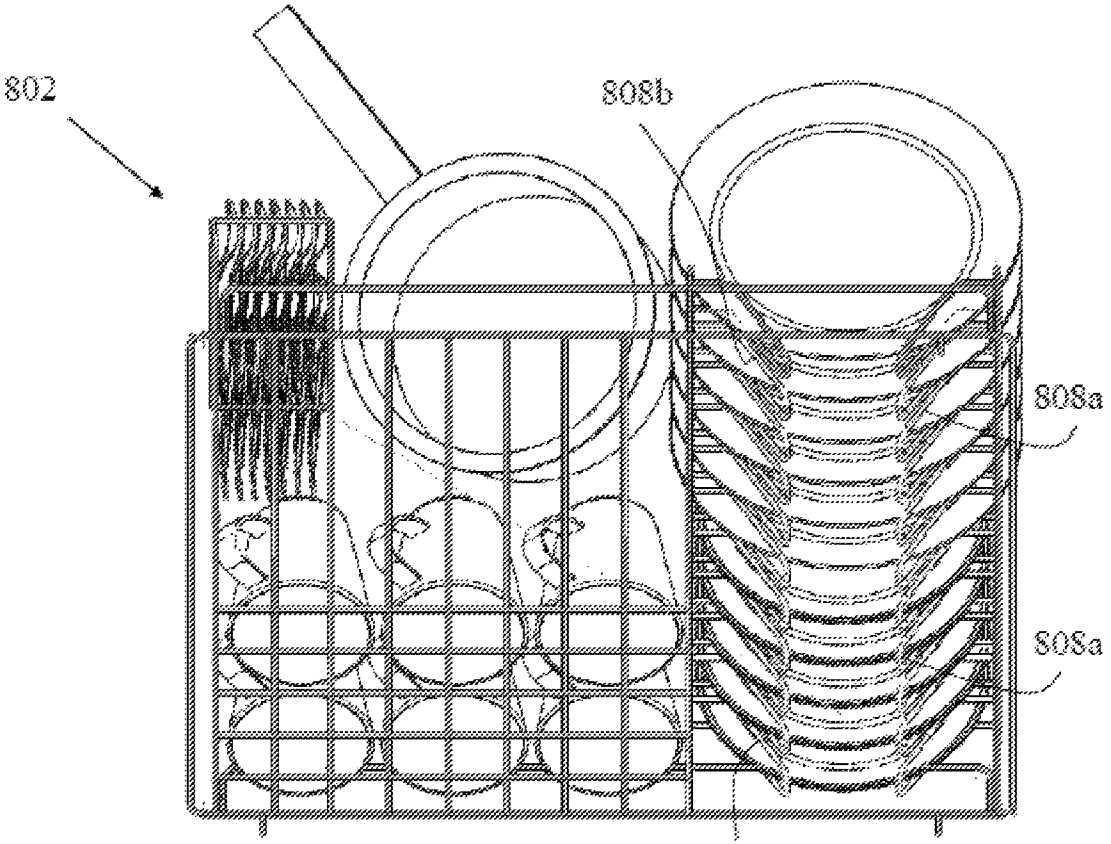
FIG. 8 provides a perspective view of a dish rack being mountable within the basin disclosed herein, according to some embodiments.

FIG. 8 provides a perspective view of a (dish) rack 802, according to some embodiments. Rack 802 is configured to be mounted within basin 112. According to some embodiments, rack 802 is configured for oblique placement thereon of tableware (e.g. plates), as elaborated on below. According to some embodiments, rack 802 is configured for non-upright placement thereon of tableware (e.g. plates), as elaborated on below.

It is to be understood that any waste on dishes placed on the dish supporting section of rack 802 drops into the space between rows 808*a* and 808*b*, so that during a washing cycle the organic waste is washed into waste disposal unit 206 and shredded therein.

According to some embodiments, dishes are placed obliquely on rack 802. The placement of dishes on rack 802 is said to be "oblique" in the sense that at least some of the dishes, are placed on rack 802 at substantially right angles to base 124 but not in parallel to any of walls 122. Consequently, during a washing cycle, water jets ejected through wall apertures 132 can hit the dishes at an oblique angle (e.g. at 45°). This holds with respect to both water jets from inner walls 604*a* and 604*c* and from fourth inner wall 604*d*. For example, during a washing cycle, fluid jets from inner chamber 612*a*1 hit one surface of a dish placed on rack 802 (e.g. the food bearing surface of a plate) and fluid jets from inner chamber 612*d*2 hit the second surface of the dish.

According to some embodiments, during a washing cycle, fluid jets from inner chamber 612*a*1, 612*d*1, 612*d*2, and 612*c*3 may be deflected by some dishes placed on rack 802 (in region A) so as to hit other tableware placed on rack 802 (particularly in region B). For example, fluid jets may be deflected from one surface of a plate onto a bowl, a cup or a surface of another plate.

It is noted that if rack 802 were configured standardly, that is, for non-oblique placement thereon of tableware, then a plate flanked by two other plates, would substantially not be subjected to direct impact by any of the water jets. In particular, water jets from first wall 122*a* would potentially not hit the plate, while water jets from fourth wall 122*d* would be directed substantially parallel to the plate potentially affording little impact.

As used herein, a water jet (or fluid jet) is said to hit a surface at an oblique angle (diagonally), even when the jet has an angular spread, so long as the center of the jet hits the surface at a substantially oblique angle.

According to some embodiments, rack 802 and basin 112 are configured such as to allow rack 802 to be removably attached onto basin 112. According to some embodiments, base 124 includes holes, e.g. four (4) holes, for example, holes each having a diameter of 0.5 cm, adapted to accept corresponding pegs ("legs") on the bottom of rack 802 such that to reversibly attach rack 802 to basin 112.

According to some embodiments, the pegs include magnets which are strong enough to maintain rack 802 attached to base 124 during a washing cycle, even in the presence of water jets having a pressure of up to about 20 bars.

According to some embodiments, instead of rack 802 being configured for oblique placement thereon of plates, wall apertures 132 are configured for "oblique" ejection of water jets, in the sense that water jets are ejected obliquely relative to the inner wall of the inner chamber wherefrom the water jets are ejected. Consequently, water jets hit plates on rack 802 at oblique angles. Also contemplated are embodiments, wherein both rack 802 is configured for oblique placement thereon of dishes and wall apertures 132 are configured for ejection of water jets at oblique angles such that the water jets hit dishes on rack 802 at oblique angles.

Typically, the basin of a sink measures between 19 cm to 22 cm in depth. According to some embodiments, basin 112 measures between 19 cm to 22 cm in depth. According to some embodiments, basin 112 measures 15 cm in depth when the placement angle of dishes/plates in rack 802 is about 30° with respect to base 124 (i.e. the xy plane). According to some embodiments, basin 112 measures 28 cm in depth when the placement angel of dishes/plates is vertical, or close to vertical (e.g. when the placement angle is about 80° with respect to base 124). Thus, use of a standard rack, wherein dishes are placed upright (in parallel to the z axis) in a sink with standard measurements (and having dishwasher functionalities) is limited to dishes of a diameter smaller than the depth of the sink. According to some embodiments (not depicted in FIG. 8), rack 802 is configured for non-upright placement of dishes thereon, thereby solving the above-mentioned problem. According to some exemplary embodiments, rack 802 is configured for placing thereon dishes at an angle of about 45° relative to the z axis, thereby allowing running a washing cycle with dishes having a diameter as large as about 25 cm or even 28 cm when basin 112 measures 20 cm or 22 cm in depth, respectively. According to some exemplary embodiments, rack 802 is configured for placing thereon dishes at an angle larger than 45° relative to the z axis, for example, at an angle of 50° to 70° relative to the z axis. According to some exemplary embodiments, rack 802 is configured for horizontal, or substantially horizontal, placement thereon of dishes (e.g. perpendicularly, or substantially perpendicularly to the z axis).

Figure 9:
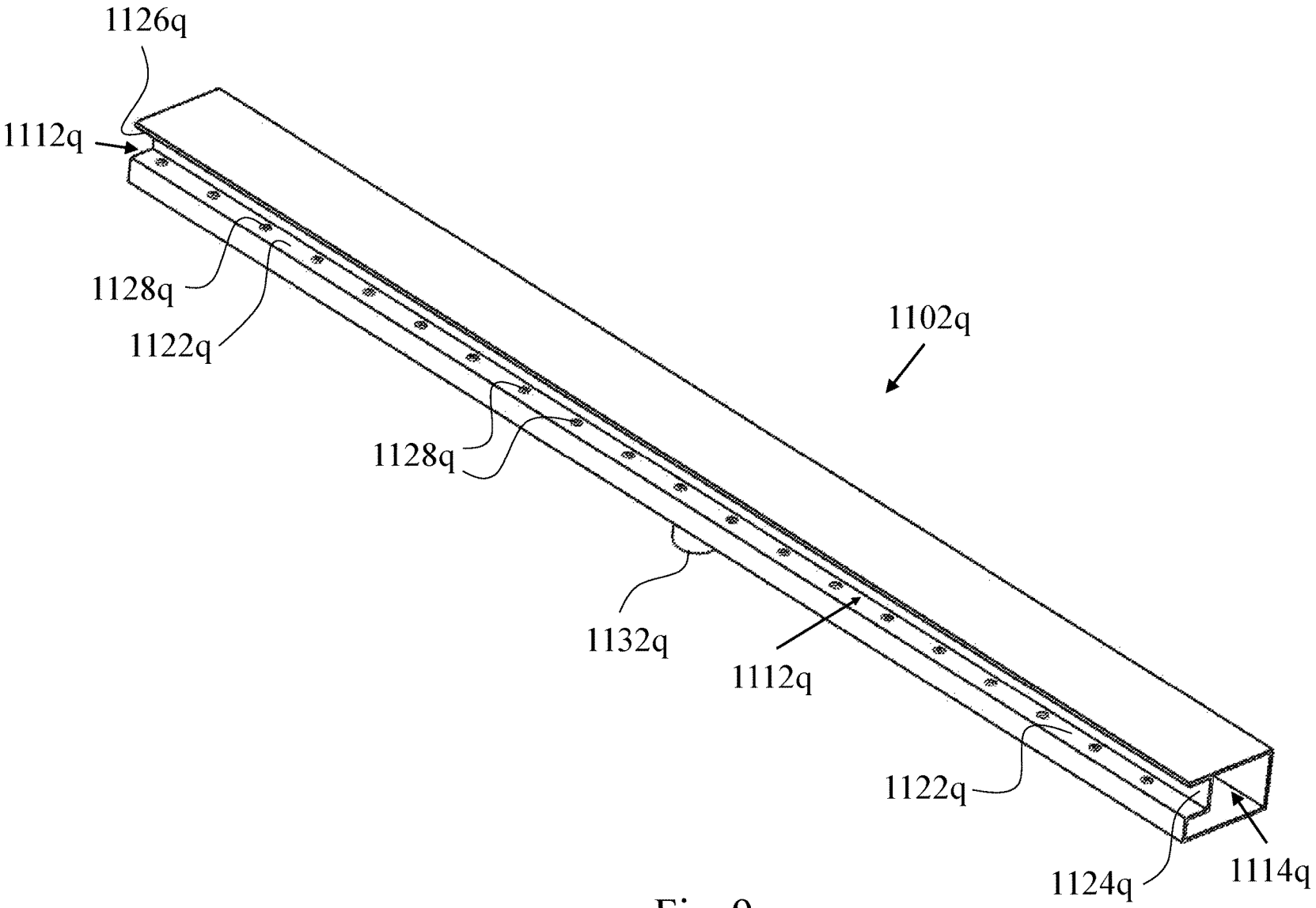
FIG. 9 provides a perspective view of a horizontal segment of a shutter track of the sink of FIG. 1, according to some embodiments.
Figure 10A:
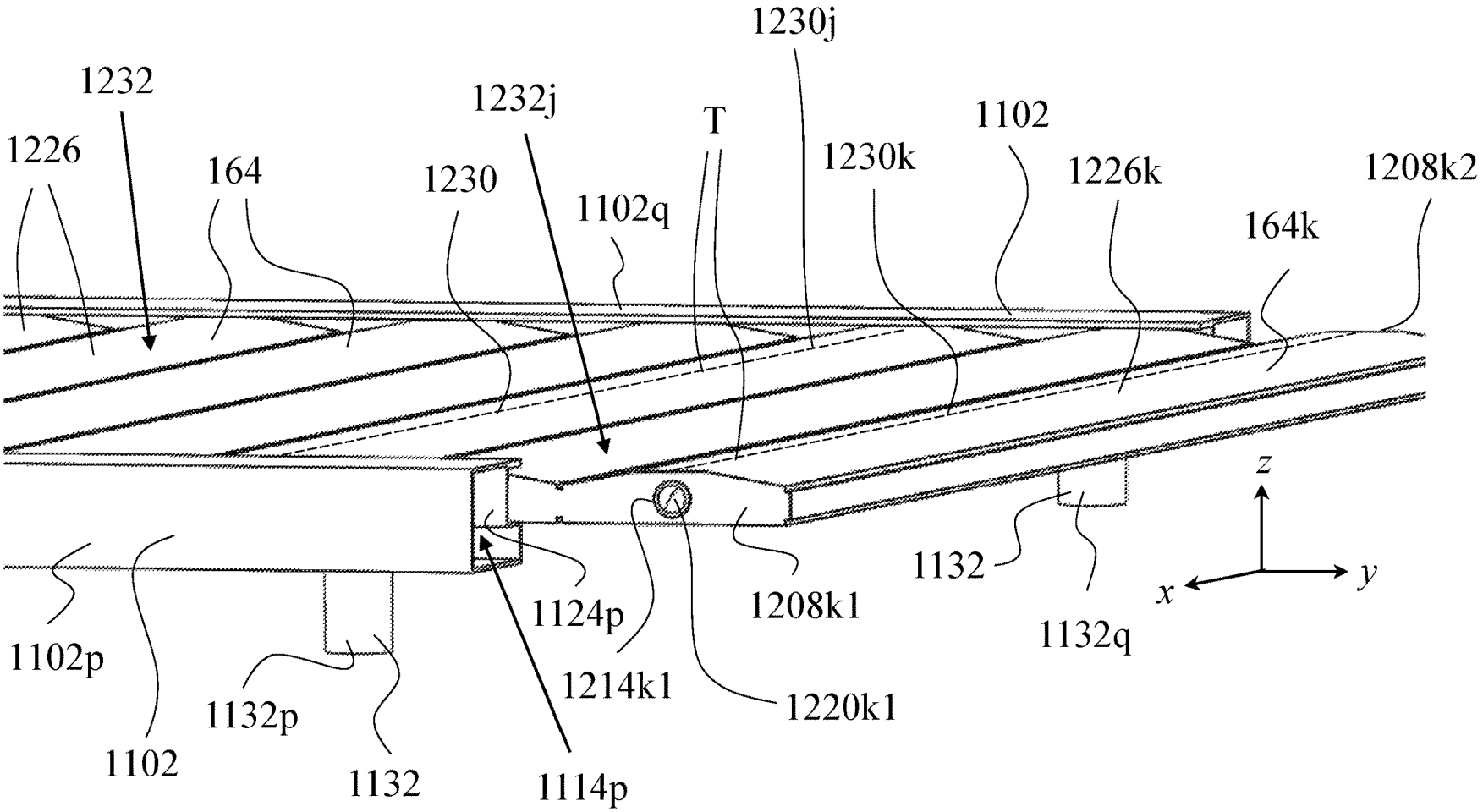
FIG. 10*a* provides perspective views of a shutter of the sink of FIG. 1 mounted on the shutter track of FIG. 9 and an opposite shutter track, according to some embodiments.
Figure 10B:
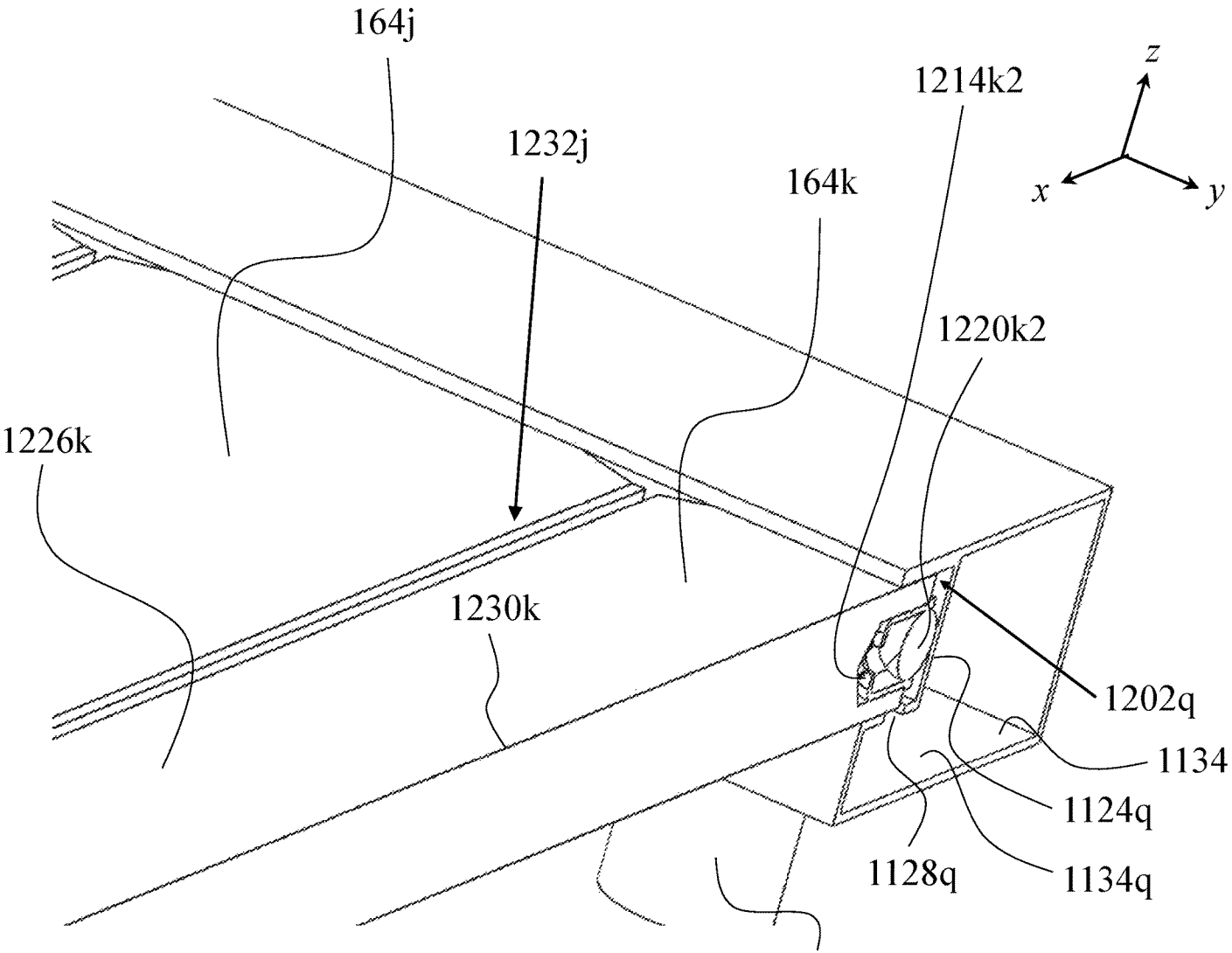
FIGS. 10*b*-10*c* provide cross-sectional views of the shutter of FIG. 10*a* mounted on the shutter tracks of FIG. 10*a*, according to some embodiments.
Figure 10C:
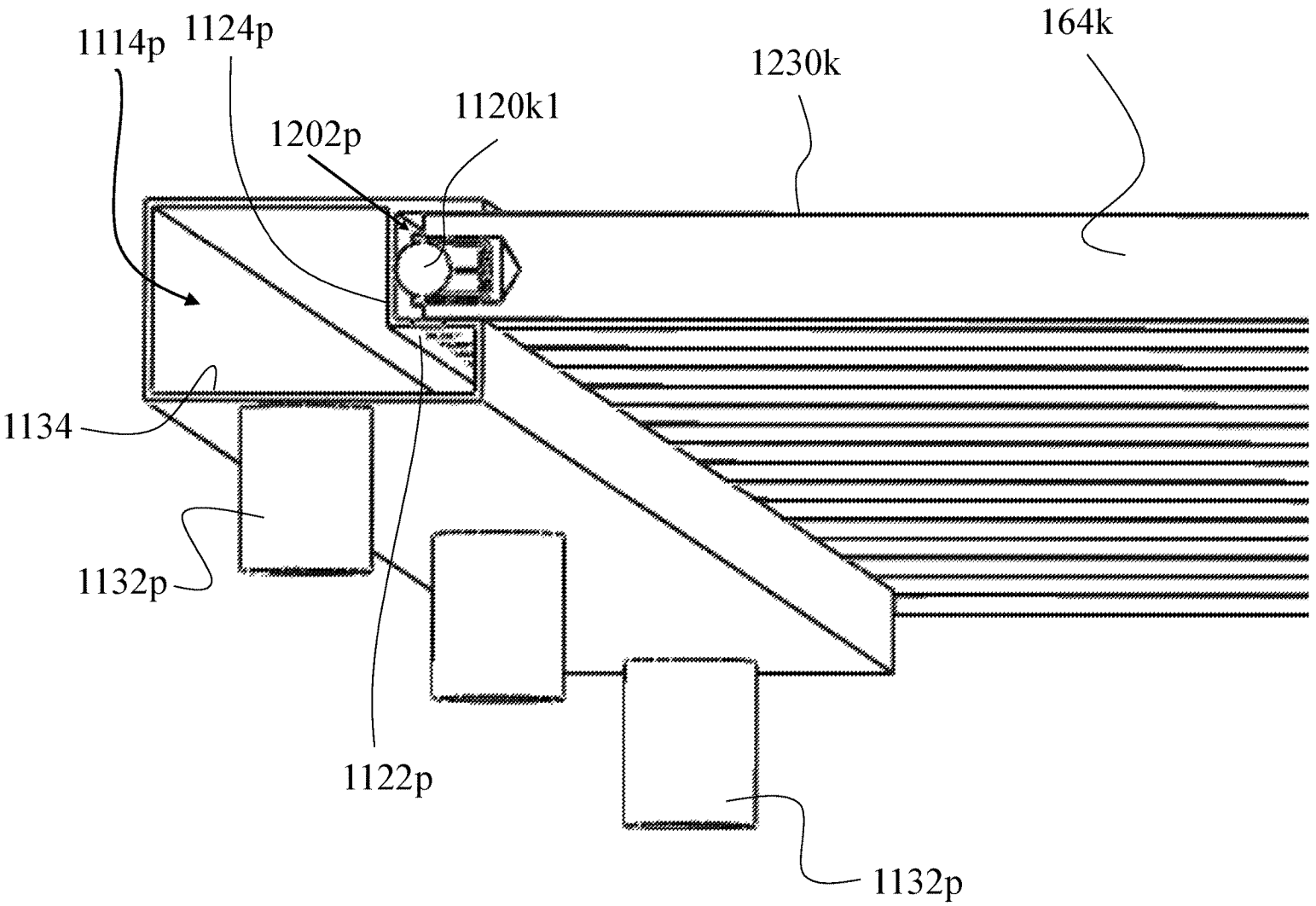

FIG. 9 provides a perspective view of a shutter horizontal segment 1102*q* of shutter track 162*q*, according to some embodiments. A shutter horizontal segment 1102*p* of shutter track 162*p*—shutter horizontal segment 1102*p* being essentially a mirror image of shutter horizontal segment 1102*q*— is depicted in FIG. 10*a* and FIG. 10*c*. Each of shutter horizontal segments 1102*p* and 1102*q* extends between second wall 122*b* and fourth wall 122*d* (on the tops thereof). Shutter horizontal segment 1102*q* includes a recess 1112*q* and a hollow portion 1114*q*. Recess 1112*q* includes a recess bottom surface 1122*q*, a recess wall 1124*q* extending along the length of shutter horizontal segment 1102*q*, and a recess top surface 1126*q* parallel to recess bottom surface 1122*q*. Recess wall 1124*q* is vertical. Recess bottom surface 1122*q* includes holes 1128*q* along the length thereof, which lead into hollow portion 1114*q*. Hollow portion 1114*q* includes one or more fluid outlets 1132*q* on a hollow portion bottom 1134*q*. According to some embodiments, each of fluid outlets 1132*q* leads into one of inner chambers 612 (thereby fluidly coupling hollow portion 1114*q* with the inner chamber).

Similarly, shutter horizontal segment 1102*p* includes a recess 1112*p* (shown in FIG. 10*c*), a hollow portion 1114*p* (shown in FIG. 10*a*) similar to recess 1112*q* and hollow portion 1114*q*, respectively.

FIG. 10*a* provides a perspective cutaway side-view of shutter 156 mounted within shutter tracks 162, wherein shutter horizontal segments 1102*p* and 1102*q* have been partially removed to reveal a slat 164*k* (of slats 164). Each of slats 164 has mounted on/in each of the ends thereof a roller. The roller includes a ball configured to rotate at least about an axis pointing along a direction defined by the thickness of the slat (e.g. the direction of the z axis when shutter 156 is closed). Each ball longitudinally extends beyond the edge of the slat on which the ball is mounted, e.g. one half of the ball extends beyond the edge of the slat, so that two thin gaps (extending in parallel to they axis), respectively, are formed between the edges of the slats and the respective recess walls: a thin gap 1202*q* and a thin gap 1202*p*, shown in FIG. 10*b* and in FIG. 10*c*, respectively.

Slat 164*k*, which, according to some embodiments, is representative of all of slats 164, includes on a first end 1208*k*1 thereof (i.e. a first edge perpendicular to the length of the slat), a first roller 1214*k*1, and on a second end 1208*k*2 thereof, a second roller 1214*k*2 (shown in FIG. 10*b*), essentially similar to first roller 1214*k*1. First roller 1214*k*1 includes a first ball 1220*k*1 configured to rotate at least about the z axis (when slat 164*k* is mounted on shutter horizontal segments 1102*p* and 1102*q*). Similarly, second roller 1214*k*2 includes a second ball 1220*k*2 (shown in FIG. 10*b*) configured to rotate at least about the z axis. As shown in FIG. 10*b*, respectively, second ball 1220*k*2 contacts, or is even slightly pressed against, recess wall 1124*q*. Similarly, as shown in FIG. 10*c*, first ball 1220*k*1 contacts, or is even slightly pressed against, a recess wall 1124*p* of recess 1112*p* of shutter horizontal segment 1102*p*. The rollers are configured to allow shutter 156 to be slid in shutter tracks 162 (due to friction between recess walls 1124*p* and 1124*q* and the balls of the rollers).

According to some embodiments, rollers 1214 (also termed 'bearings') have at least the following two functions: (1) to insure sufficient space between the edges of slats 164 and recess walls 1124 to allow water flow; and (2) to facilitate smooth opening and closing of shutter 156.

According to some embodiments, the top surfaces of slats 164, slats top surfaces 1226, are concave. More specifically, each of slats 164 is concave on the top surface thereof (e.g. slat top surface 1226*k* of slat 164*k*), such that peaks 1230 of slats 164 extend in parallel to the x axis along the length of the slats (i.e. from shutter horizontal segment 1102*q* to shutter horizontal segment 1102*p*) when shutter 156 is closed. Peaks 1230 are indicated in FIG. 10*a* by dashed straight lines T. Due to the concavity of slats 164, pairs of adjacent slats define troughs 1232 there between (i.e. depressed regions between adjacent peaks). Troughs 1232 extend in parallel to peaks 1230. For example, a trough 1232*j* is defined by slat 164*k* and a slat 164*j* adjacent thereto (a peak 1230*k* and a peak 1230*j* of slats 164*k* and 164*j* are indicated in FIG. 10*a*). When shutter 156 is closed and water is present thereon (i.e. on slats top surfaces 1226), troughs 1232 essentially act as funnels (conduits) which guide the water into recesses 1112*q* and 1112*p*. More specifically, water in each of troughs 1232 flows to the ends of the trough (between the ends of two adjacent slats), and therefrom, via thin gaps 1202*q* and 1202*p*, respectively, into recesses 1112*q* and 1112*p*. Consequently, any water on slats top surfaces 1226 eventually flows onto hollow portions 1114*q* and 1114*p*, via holes 1128*q* and 1128*p*, respectively, and therefrom into inner chambers 612 via fluid outlets 1132*q* and 1132*p*, respectively.

According to some embodiments, basin 112 includes a slot between fourth wall 1522*d* and kitchen countertop 1502. The slot is configured to accept a long (and unlinked) edge of a last slat of shutter 156. The slot includes at least one hole on the bottom thereof which is leads into one or both of inner chambers 612*d*1 and 612*d*2, being thereby configured to drain water from the top surface of shutter 156.

According to some embodiments, the ends of at least some of slats 164 (e.g. ends 1208*k*1 and 1208*k*2 of slat 164*k*) are notched. According to some such embodiments, shutter 156 and shutter tracks 162 are configured such that when shutter 156 is closed, the notches are located above holes 1128*q* and 1128*p*, thereby facilitating drainage of fluid on the top surface of shutter 156 into holes 1128*q* and 1128*p*.

Figure 11:
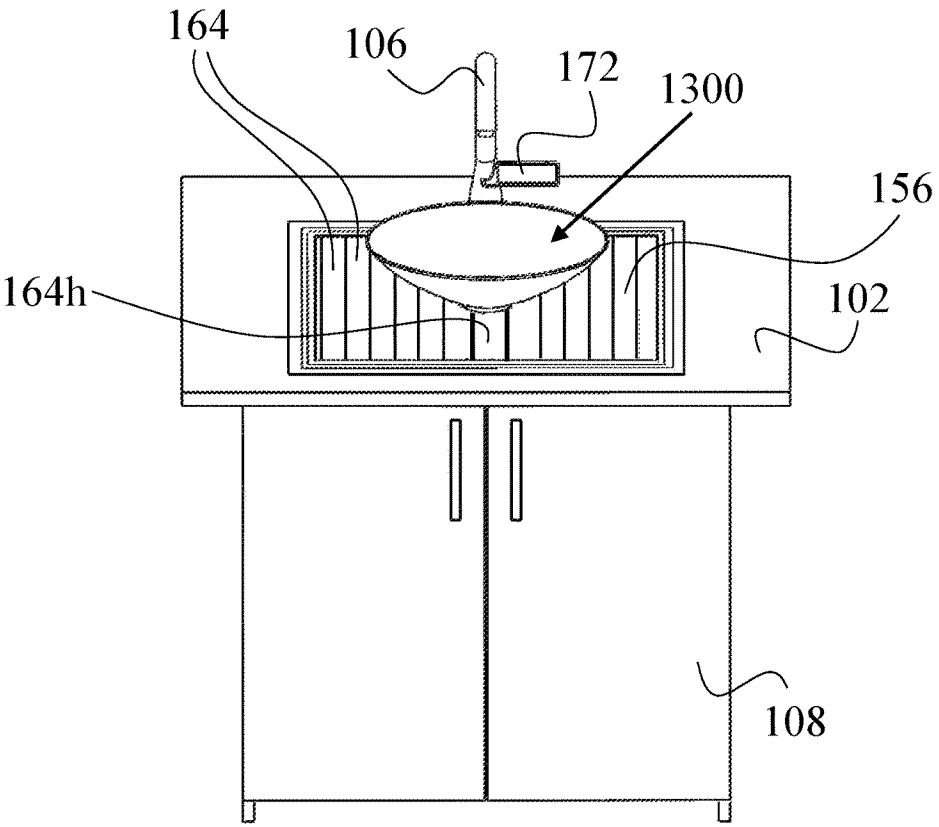
FIG. 11 provides a perspective front view of the sink of FIG. 1 with the shutter of the sink closed and a bowl affixed on top of the shutter, according to some embodiments.

FIG. 11 depicts a top perspective view of sink 100 in the second configuration with a bowl 1300 detachably mounted on shutter 156. A central slat 164*h* is located below faucet 106 when shutter 156 is closed. According to some embodiments, central slat 164*h* includes in the center thereof a bore sealed by a pin (both not shown). The pin can be released by pushing thereon from above, thereby unsealing the bore. Once the pin is no longer being pushed, the pin re-seals the bore. For example, a spring mechanism can be used to allow releasing the pin when force is exerted on the pin and to have the pin return to the original position thereof (re-sealing the bore) as soon as the force stops being applied. Bowl 1300 includes on the bottom thereof a male member (not shown) configured for mating with the bore, e.g. the male member may be a screw and the bore may be threaded. Bowl 1300 is mounted on central slat 164*h* by pushing the male member against the pin and affixing the male member in the bore, e.g. by turning bowl 1300 in embodiments wherein the male member is a screw and the bore is threaded. The male member is hollow, thereby establishing fluid communication between bowl 1300 and basin 112 when bowl 1300 is affixed on central slat 164*h*.

Figure 12A:
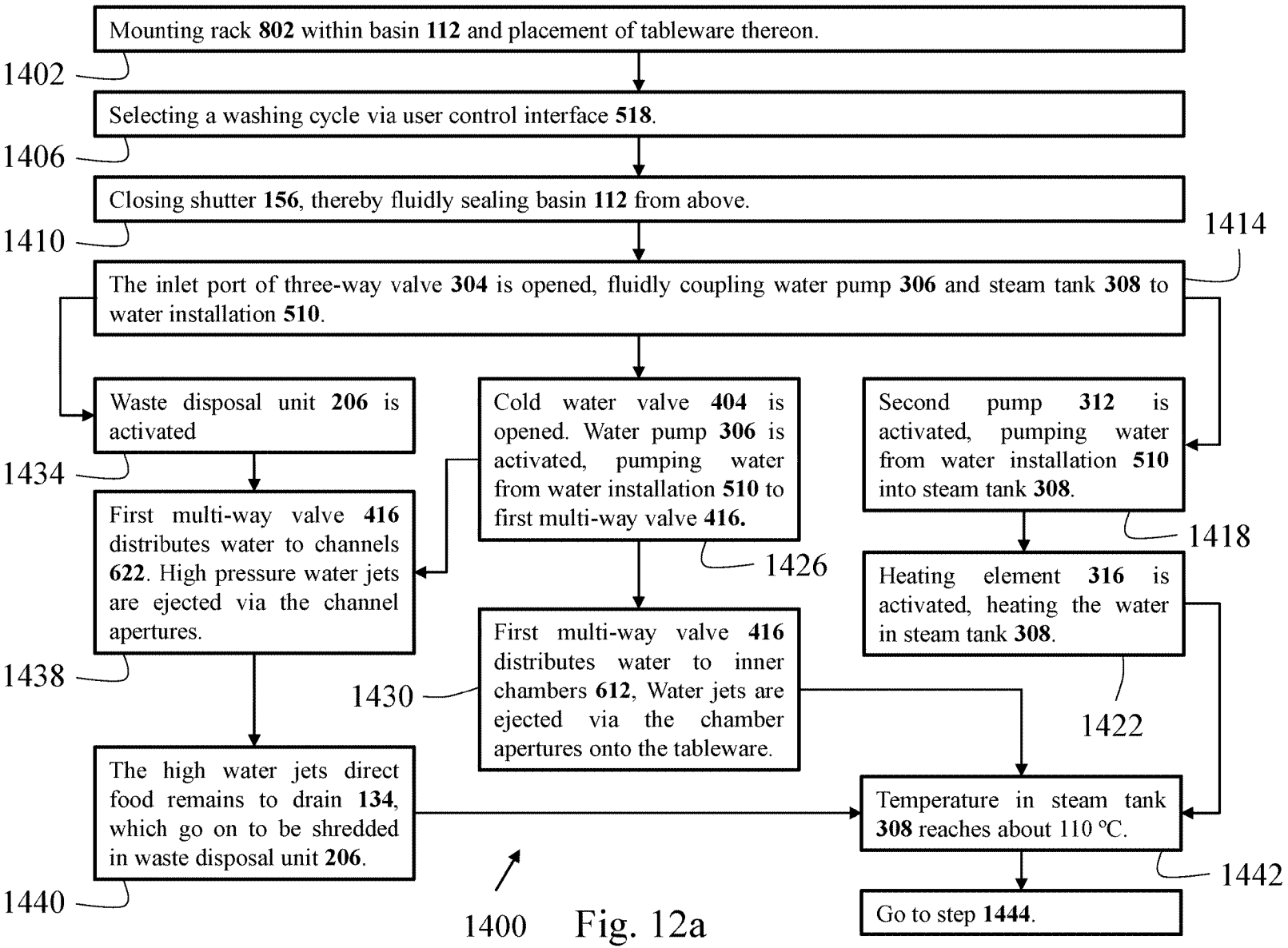
FIGS. 12*a*-12*b* provide a flow-chart of an exemplary washing cycle of the sink of FIG. 1, according to some embodiments.
Figure 12B:
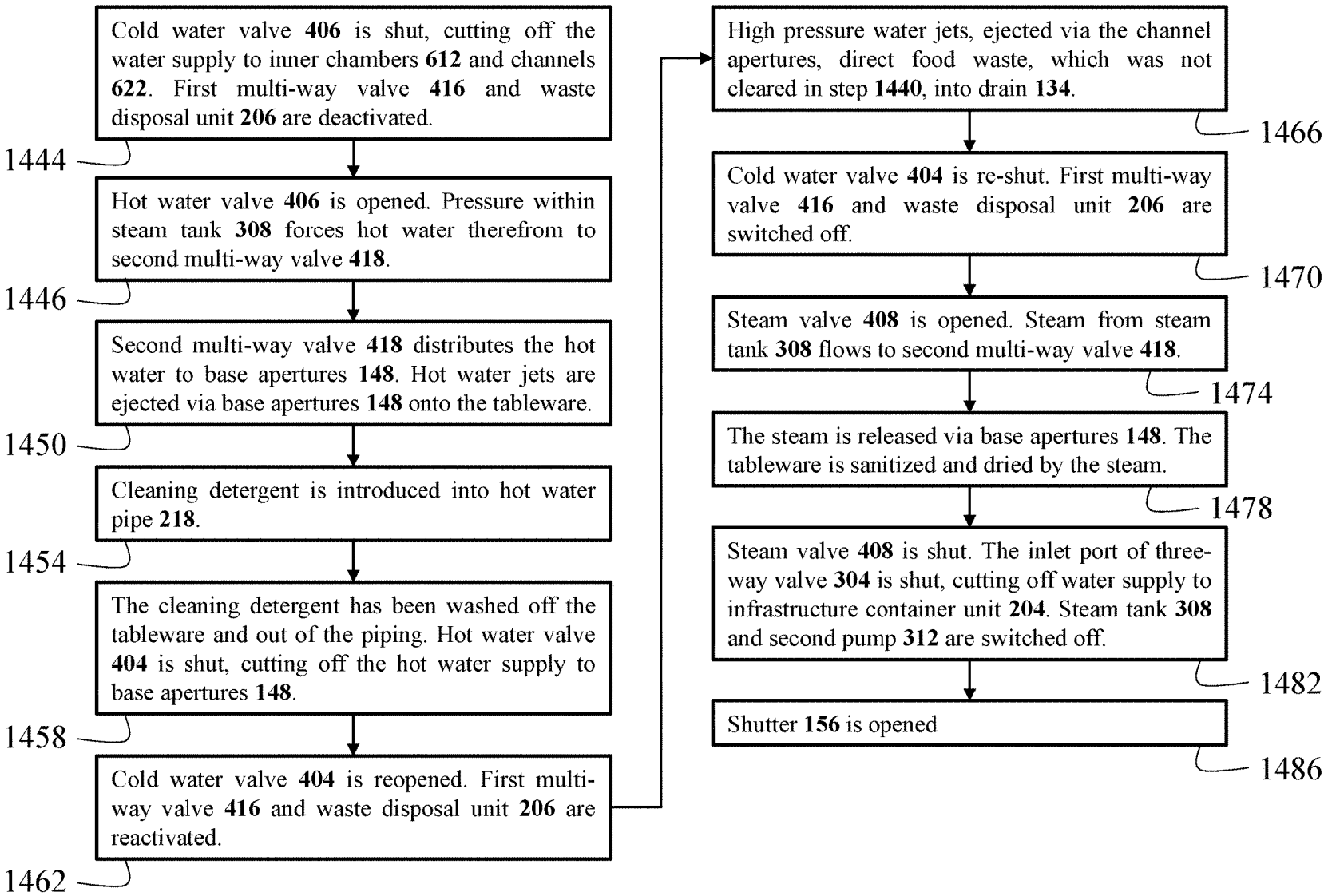

Bowl 1300 can be used as a small sink, e.g. for washing a couple of cups, when sink 100 is in the midst of a washing cycle, such as the washing cycle described in FIGS. 12*a*-12*b*, which is an open circulation washing cycle (that is to say, water or fluids from basin 112 are not recirculated back into basin 112 as part of the washing cycle). Water from faucet 106 drains via the male member into basin 112, flowing therefrom into drain pipe 230 and the sewer.

An Exemplary Washing Cycle of Sink 100

FIGS. 12*a*-12*b* depicts a flow chart of an exemplary washing cycle 1400 of sink 100, according to some embodiments. Washing cycle 1400 can include any one or more of the following steps:

A step 1402 wherein the user mounts a rack, such as rack 802, within basin 112 and places on the rack dirty tableware and cookware.

A step 1406, wherein the user selects a washing program via user control interface 172.

A step 1410, wherein shutter 156 is switched from the first configuration to the second configuration (wherein shutter 156 fluidly seals basin 112).

A step 1414, wherein the inlet port of three-way valve 304 is opened, fluidly coupling water pump 306 and steam tank 308 to water installation 510.

A step 1418, wherein second pump 312 is activated, pumping water from water installation 510, via water inlet pipe 212 and pipes 334 and 340, into steam tank 308.

A step 1422, wherein steam tank 308 is switched on (i.e. heating element 316 is activated), heating the water pumped therein.

A step 1426, wherein cold water valve 404 is opened. Water pump 306 is activated, pumping water from water installation 510 (via water inlet pipe 212, pipe 328, cold water pipe 216, cold water valve 404, and pipe 432) to first multi-way valve 416 inlet port 444.

A step 1430, wherein first multi-way valve 416 distributes water via outlet ports 446 to inner chambers 612. Water jets are ejected via the chamber apertures (i.e. first set of apertures 140) onto the tableware and cookware.

A step 1434, wherein waste disposal unit 206 is activated.

A step 1438, wherein first multi-way valve 416 distributes water via outlet ports 446 to channels 622. High pressure water jets are ejected via the channel apertures (i.e. second set of apertures 142).

A step 1440, wherein the high pressure water jets direct food waste into drain 134 (wherefrom the food waste is directed into waste disposal unit 206 and shredded therein).

A step 1442, wherein the temperature in steam tank 308 reaches above 100° C., e.g. up to 120° C.

A step 1444, wherein cold water valve 404 is shut, cutting off the water supply to inner chambers 612 and channels 622. First multi-way valve 416 and waste disposal unit 206 are deactivated.

A step 1446, wherein hot water valve 406 is opened. Pressure within steam tank 308 forces hot water (at boiling temperature or at about boiling temperature) therefrom to second multi-way valve 418 first inlet port 454*a* (via hot water pipe 218, hot water valve 406, and pipe 434).

A step 1450, wherein second multi-way valve 418 distributes the hot water via outlet ports 456 to base apertures 148, and, optionally, via some of wall apertures 132. Hot water jets are ejected via base apertures 148 and, optionally, via some of wall apertures 132, onto the tableware and cookware on the rack.

A step 1454, wherein cleaning detergent is injected. According to some embodiments, the cleaning detergent is injected from a refillable dispenser tank (not shown) to pipe 436 and/or pipe 432 by means of a diaphragm valve (not shown) that is controlled by secondary controller 402.

A step 1458, wherein the cleaning detergent has been washed off the tableware and cookware and out of the piping (e.g. pipes and valves). Hot water valve 406 is shut, cutting off the hot water supply to base apertures 148. Second multi-way valve 418 is deactivated.

A step 1462, wherein cold water valve 404 is reopened, first multi-way valve 416 and waste disposal unit 206 are reactivated. Water is ejected from inner chambers 612.

A step 1466, wherein high pressure water jets, ejected via the channel apertures, direct food waste, which was not cleared in step 1440, into drain 134.

A step 1470, wherein cold water valve 404 is shut again. First multi-way valve 416 and waste disposal unit 206 are switched off.

A step 1474, wherein steam valve 408 is opened. Steam from steam tank 308 flows to second multi-way valve 418 second inlet port 454*b* (via steam pipe 220, steam valve 408, and pipe 436).

A step 1478, wherein the steam is released via base apertures 148. The tableware and cookware is sanitized and dried by the steam.

A step 1482, wherein steam valve 408 is shut. The inlet port of three-way valve 304 is shut and water supply from water installation 510 to infrastructure container unit 204 is cut off. Steam tank 308, second pump 312, and second multi-way valve 418 are switched off.

A step 1486, wherein shutter 156 is opened.

According to some embodiments, steam tank 308 includes water and hot compressed air (i.e. steam). According to some embodiments, the water within steam tank 308 is heated under pressure, such that some of the water is turned into steam (compressed air having a temperature between about 95° C. to about 120° C.

According to some embodiments, the duration of each step ranges from seconds to minutes. According to some embodiments, the duration of an entire washing cycle is less than 20 minutes. According to some embodiments, the duration of an entire washing cycle is less than 10 minutes. According to some embodiments, the duration of an entire washing cycle is about 5 minutes.

According to some embodiments, in step 1430, first multi-way valve 1430 selectively distributes the water to inner chambers 612, such that the water is delivered (supplied) to one inner chamber at a time. According to some such embodiments, the water jets are ejected in a rotating pattern as discussed above.

The term "cleaning detergent" as used herein includes, but is not limited to, dish soap, and liquids including dish soap, and varnish/or and salts.

According to some embodiments, sink 100 is configured to allow for economical washing cycle programs wherein basin 112 is only partially filled with tableware. The washing cycle programs are said to be "economical" in the sense of taking account of the fact that basin 112 is only partially filled, e.g., the dirty tableware fill only one half or one third of basin 112. For example, in the event that only dirty plates need to be washed, only region A is filled with tableware. The user may then select a washing cycle program that takes into account the fact that tableware is present only in region A. Such a washing cycle program will be similar to the washing cycle program described in FIGS. 12*a*-12*b* but will differ therefrom in that in a step analogous to step 1430, water jets will be ejected only from inner chambers 612*a*1, 612*c*3, 612*d*1, and 612*d*2, and optionally from inner chambers 612*b*1 and 612*b*2, but no water jets will be ejected from inner chambers 612*a*2, 612*a*3, 612*c*1, and 612*c*2. Similarly, in a step analogous to step 1450, water jets will be ejected only from base apertures (from base apertures 148) located in region A, and so on.

According to some embodiments, sink 100 includes sensors for detecting load and location of tableware contained therein.

Figure 13:
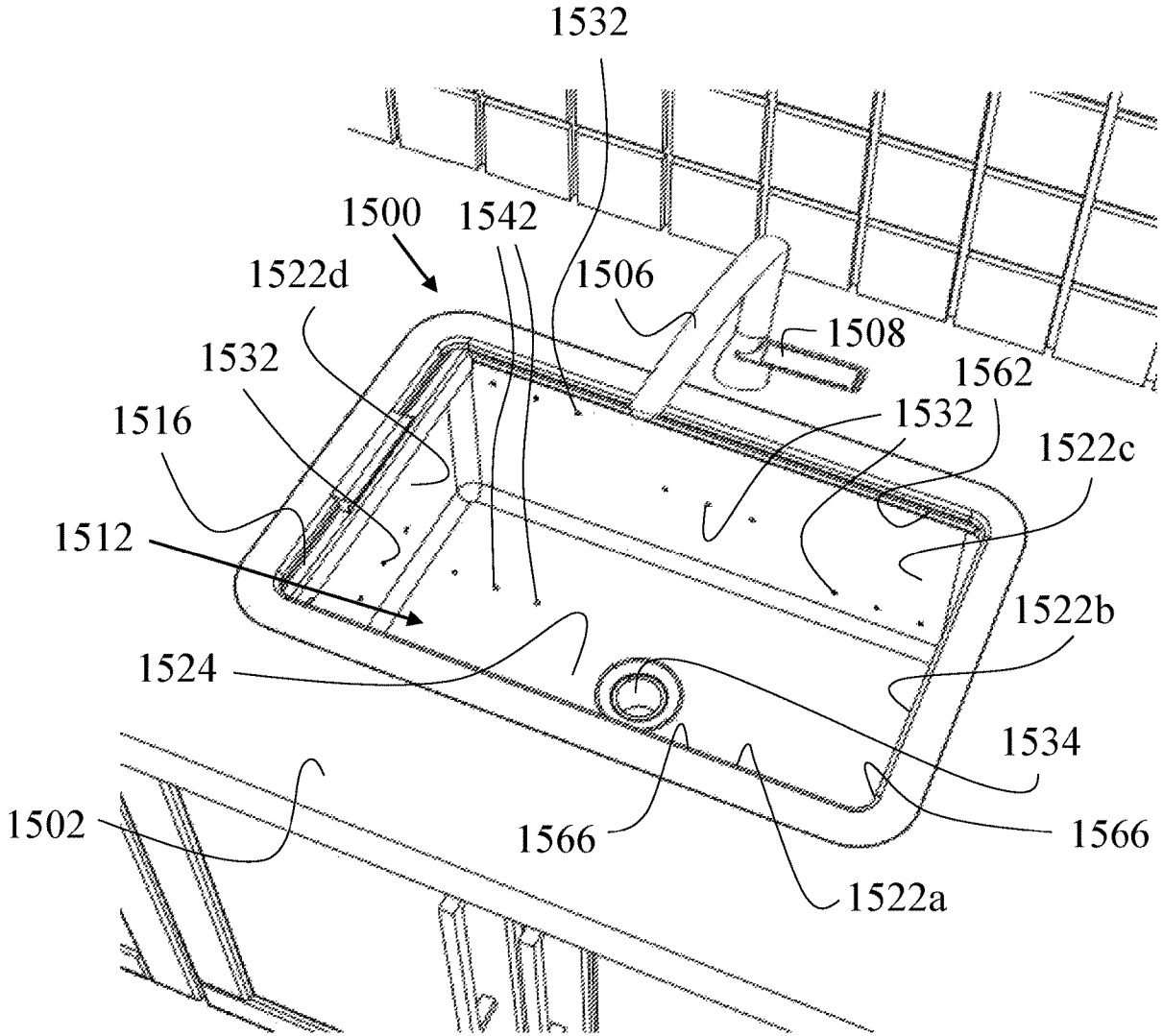
FIG. 13 provides a perspective view of a sink with dishwasher functionalities mounted within a kitchen countertop, the sink is in a first configuration with an open shutter, according to some embodiments.

According to another aspect of the disclosed technology, there is provided a sink with dishwasher functionalities. FIG. 13 provides a perspective view from above of a sink 1500 with dishwasher functionalities, according to some embodiments. Further depicted are a kitchen countertop 1502, wherein sink 1500 is installed, and a faucet 1506. Sink 1500 is similar to sink 100—sharing some features therewith, as elaborated on below—but fundamentally differs therefrom at least in not being double walled and in necessarily including a shutter as a cover.

According to some embodiments, sink 1500 includes faucet 1506.

According to some embodiments, faucet 1506 includes a user control interface 1508 similar to user control interface 172 of sink 100.

Figure 14:
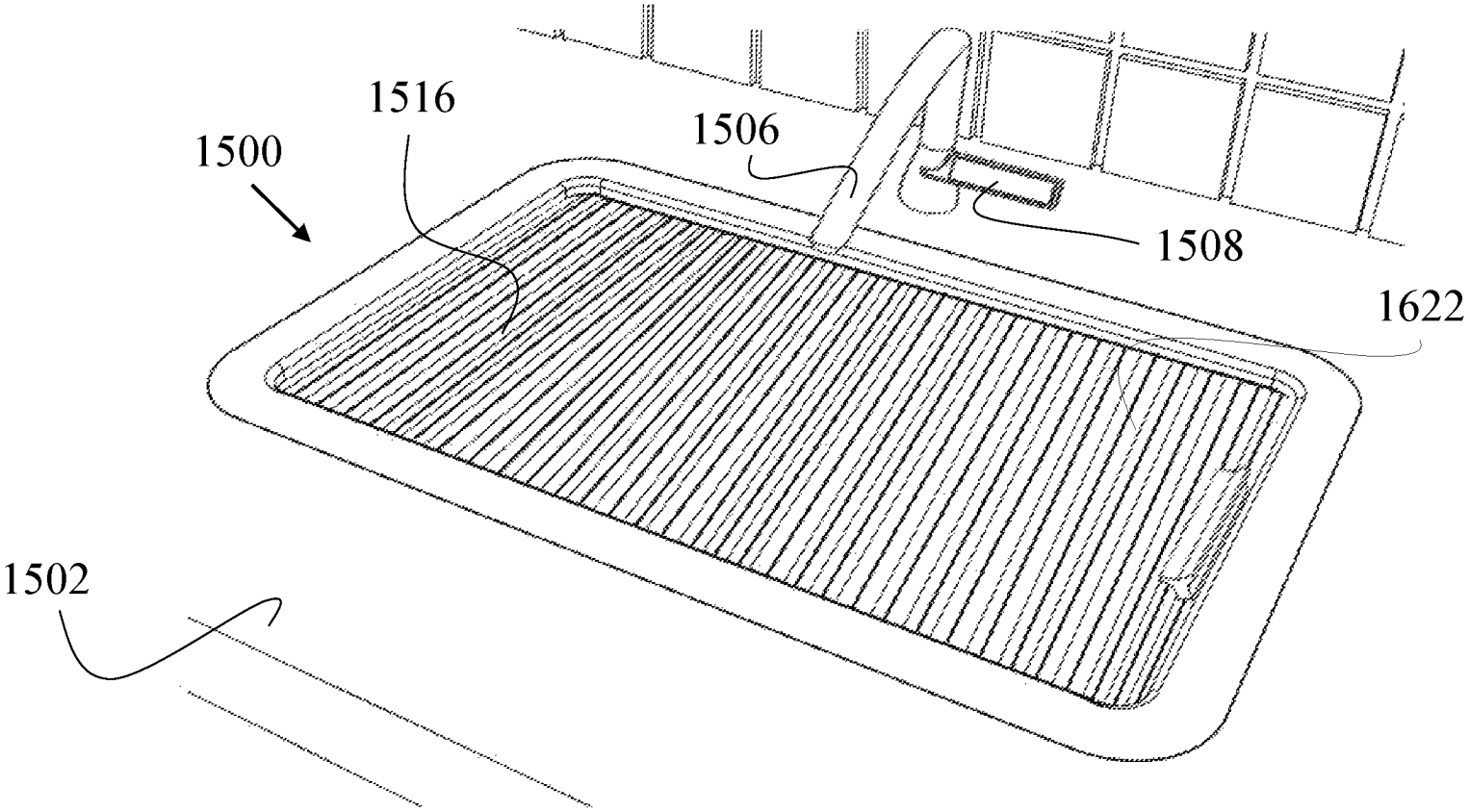
FIG. 14 provides a perspective view of the sink of FIG. 13 in a second configuration with a closed shutter, according to some embodiments.

Sink 1500 includes a basin 1512 and a shutter 1516. Shutter 1516 is switchable between two configurations: a first configuration wherein shutter 1516 is open (i.e. basin 1512 is uncovered from above as depicted in FIG. 13) and a second configuration wherein shutter 1516 is closed and fluidly seals basin 1512 from above (i.e. from the top of basin 1512, as depicted in FIG. 14). Basin 1512 includes walls 1522 and a base 1524. Walls 1522 include wall apertures 1532, as elaborated on below. Base 1524 further includes a drain 1534, which is fluidly coupled to a drain pipe 1538 (shown in FIG. 15). Base 1524 further includes base apertures 1542, as elaborated on below. Walls 1522 can further include a compartment (not shown) for a dishwasher (cleaning) detergent (e.g. tablet), which is released into basin 1512 during a washing cycle.

According to some embodiments, basin 1512 is rectangular and walls 1522 number four walls: a first wall 1522*a* parallel to the zx plane, a second wall 1522*b* perpendicular to first wall 1522*a* (and parallel to the yz plane), a third wall 1522*c* parallel to first wall 1522*a*, and a fourth wall 1522*d* parallel to second wall 1522*b*.

According to some embodiments, basin 1512 is rounded, e.g. being shaped as half of a sphere or half of an ellipsoid.

Sink 1500 further includes a pair of parallel shutter tracks 1562 on a rim 1566 of basin 1512. More specifically, shutter tracks 1562 are located on the top of first wall 1522*a* and third wall 1522*c*, respectively (only the shutter track on top of third wall 1522*c* is indicated). Shutter 1516 is configured to be slid along shutter tracks 1562, similarly to the sliding of shutter 156 on shutter tracks 162. The top of fourth wall 1522*d* is separated from kitchen countertop 1502 by a narrow gap (not shown), similarly to second wall 122*b* and kitchen countertop 102. When switching from/to the first configuration, wherein shutter 1516 is stored below kitchen countertop 1502 (e.g. adjacent to fourth wall 1522*d* as shown in FIG. 15) to/from the second configuration, shutter 1516 is slid through the narrow gap, as further elaborated on below.

FIG. 14 provides a perspective view of sink 1500 from above, according to some embodiments. In FIG. 14 shutter 1516 is in the second configuration fluidly sealing basin 1512 from above. A shutter top surface 1622 of shutter 1516 is depicted, according to some embodiments.

Figure 15:
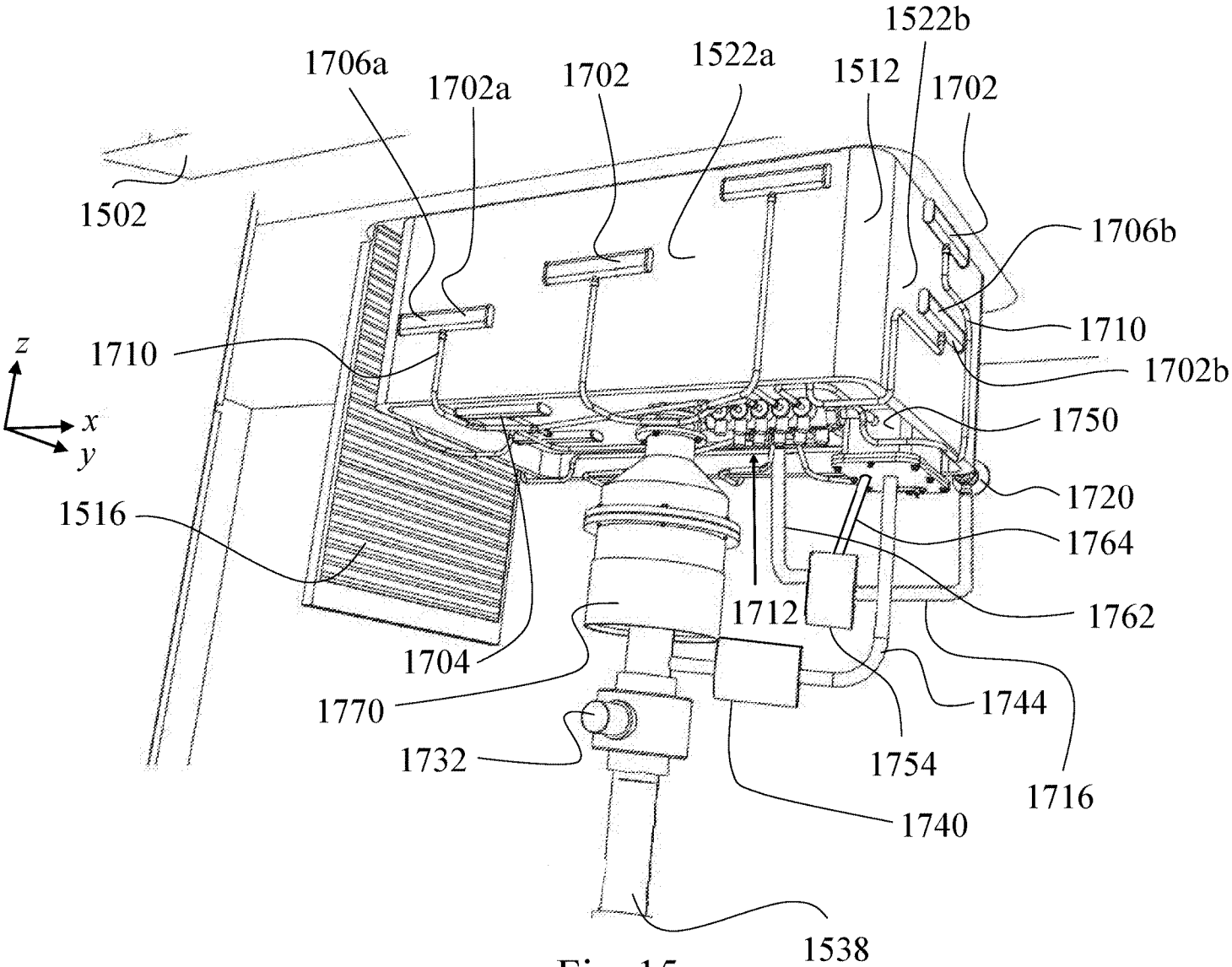
FIG. 15 provides a perspective bottom view of the sink of FIG. 13 depicting infrastructure of the sink, according to some embodiments.

FIG. 15 provides a perspective view of sink 1500 from below, according to some embodiments. Wall apertures 1532 and base apertures 1542 are controllably fluidly coupled to a (domestic) water installation. More specifically, basin 1512 includes horizontal wall channels 1702, each defining a pair of surfaces parallel to either the yz plane or the zx plane, such that a first (and inner) surface coincides with one of walls 1522 and a second (and outer) surface projects (outwardly) from basin 1512. For example, a wall channel 1702*a* on first wall 1522*a* includes a (second) surface 1706*a* projecting outwardly from first wall 1522*a* (and parallel to the zx plane), and a wall channel 1702*b* on second wall 1522*b* includes a (second) surface 1706*b* projecting outwardly from second wall 1522*b* (and parallel to the yz plane). Each of wall channels 1702 includes a plurality of wall apertures from wall apertures 1532 on the respective inner surfaces thereof. Basin 1512 further includes base channels 1704, each defining a pair of surfaces parallel to the xy plane, such that a first (and inner) surface coincides with base 1524 and a second (and outer) surface projects downwards from base 1524.

Sink 1500 further includes channel pipes 1710. Each of channel pipes 1710 is fluidly connected on one end thereof to a respective one of wall channels 1702 or base channels 1704, and on the other end thereof to a respective outlet port (not numbered) of a multi-way valve 1712. Multi-way valve 1712 is controllably fluidly coupled to the water installation via a water inlet pipe 1716 and a tap 1720 (located on a kitchen wall behind kitchen countertop 1502).

After the water, in water heating tank 1750 reaches a target temperature, e.g. 90° C., a valve (not shown) is opened an hot fluid flows through a pipe (not shown) to multi-way valve 1712. According to some embodiments, there are 14 ports for multi-way valve 1712.

During a washing cycle, water from the water installation flows through water inlet pipe 1716 onto multi-way valve 1712 which controllably (and optionally selectively) distributes the water among channel pipes 1710. From each of channel pipes 1710 water flows onto a respective one of wall channels 1702 or base channels 1704 and is ejected therefrom (via respective apertures from wall apertures 1532 or respective apertures from base apertures 1542) as water jets into basin 1512.

According to some embodiments, sink 1500 further includes a recirculation valve 1732, which is a three-way valve, and a recirculation pump 1740 fluidly coupled to multi-way valve 1712 via a pipe 1744. Recirculation valve 1732 is fluidly coupled on the inlet port thereof to drain 1534 and allows controllably switching between a first flow configuration and a second flow configuration: In the first flow configuration, drain 1534 is fluidly coupled to drain pipe 1538 (via a first outlet port of recirculation valve 1732), and is fluidly decoupled from recirculation pump 1740 (the second outlet port of recirculation valve 1732 is shut), so that fluids flowing through drain 1534 continue onto the sewer via drain pipe 1538. In particular, when used as a standard sink (i.e. not as a dishwasher), sink 1500 is in the first flow configuration. In the second flow configuration, drain 1534 is fluidly coupled to recirculation pump 1740 (via the second outlet port of recirculation valve 1732), and is fluidly decoupled from drain pipe 1538 (the first outlet port of recirculation valve 1732 is shut), so that fluids flowing through drain 1534 continue onto recirculation pump 1740, and therefrom, are pumped back into basin 1512 (due to recirculation pump 1740 fluid-coupling to multi-way valve 1712). The second flow configuration can be used during a washing cycle to effect closed fluid circulation, wherein fluid used to wash tableware and cookware in basin 1512 is redirected back into basin 1512 after being drained, thereby potentially saving on both water and cleaning detergents (and optionally on electricity consumption in embodiments wherein the water is heated), as further elaborated on below.

According to some embodiments, and as depicted in FIG. 15, sink 1500 includes a water heating tank 1750 and a three-way valve 1754. Three-way valve 1754 is controllably fluidly connected to water inlet pipe 1716, such as to allow turning on and off the water supply from tap 1720. Three-way valve 1754 is further configured to controllably fluidly couple water inlet pipe 1716 to wall channels 1702 and base channels 1704, via multi-way valve 1712 and a first outlet pipe 1762, and to water heating tank 1750 via a second outlet pipe 1764. According to some embodiments, three-way valve 1754 is configured to allow simultaneous fluid-coupling of water inlet pipe 1716 to both multi-way valve 1712 and water heating tank 1750 and to control the proportion of the flow rates of water (from tap 1720) directed to each.

Water heating tank 1750 is controllably fluidly coupled to multi-way valve 1712 via an inlet port (not numbered) of multi-way valve 1712.

According to some embodiments, wherein sink 1500 does not include water heating tank 1750 (and three-way valve 1754), hot water may be supplied from the (domestic) hot water installation.

According to some embodiments, and as depicted in FIG. 15, sink 1500 includes a waste disposal unit 1770. Waste disposal unit 1770 is fluidly connected to drain 1534 on one end thereof and to recirculation valve 1732 on the other end thereof.

Sink 1500 includes an electronic controller (not shown), combining features of main controller 302 and secondary controller 402 detailed above in the description of sink 100. The electronic controller is communicatively associated with user control interface 1508. In particular, the electronic controller controls and coordinates the operation of multi-way valve 1712, recirculation valve 1732, recirculation pump 1740, water heating tank 1750, three-way valve 1754, and waste disposal unit 1770.

The electronic controller and other components of sink 1500, such as user control interface 1508, shutter 1516, recirculation pump 1740, water heating tank 1750, and multi-way valve 1712 in embodiments wherein multi-way valve 1712 is electronic, are powered by the home electrical system (not shown). To keep the Figures simple and clear, electrical wires connecting various components of sink 1500 to one another and the home electrical system are not shown.

According to some embodiments, sink 1500 includes a cleaning detergent pump (not shown), which is configured to controllably introduce cleaning detergent into first outlet pipe 1762, thereby mixing with cleaning detergent cold water flowing into basin 1512 during a washing cycle.

Additionally or alternatively, sink 1500 includes a cleaning detergent pump, which is configured to controllably introduce cleaning detergent into second outlet pipe 1764 or into water heating tank 1750, thereby mixing with cleaning detergent hot water flowing into basin 1512 during a washing cycle.

According to some embodiments, first outlet pipe 1762 and/or second outlet pipe 1764 includes a salt filter (not shown) for releasing salt into water (or fluids) flowing there through.

Figure 16:
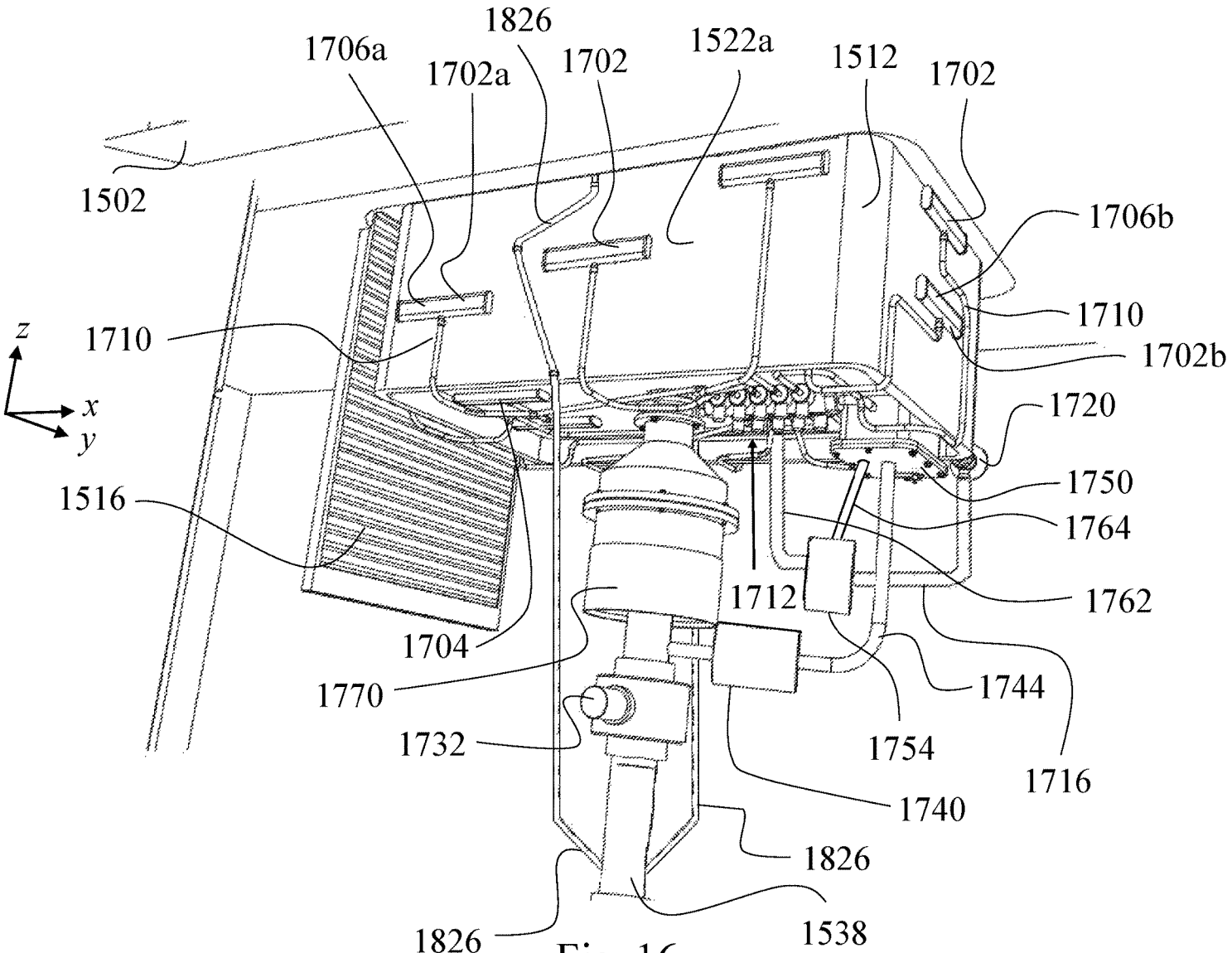
FIG. 16 provides a perspective bottom view of the sink of FIG. 13 depicting infrastructure of the sink, according to some embodiments wherein a shutter and shutter tracks of the sink are configured for drainage of fluids on a top surface of the shutter when the shutter is closed.

Making reference to FIG. 16, FIG. 16 provides a perspective view of a sink 1800 from below. Sink 1800 is a specific embodiment of sink 1500, wherein shutter 1516 and shutter tracks 1562 are configured for drainage of water located on shutter top surface 1622 (when the shutter is closed), thereby allowing to use faucet 1506 even when sink 1800 is in the midst of a washing cycle, e.g. in order to manually wash a dish. According to some such embodiments, shutter 1516 and shutter tracks 1562 are similar to shutter 156 and shutter tracks 162 embodiments depicted in FIGS. 9-10*c* and described in the accompanying description, but differ therefrom in that the fluid outlets on the bottom of the respective bottoms of the hollow portions of the shutter tracks do not lead back into basin 1512 (whereas fluid outlets 1132, i.e. fluid outlets 1132*q* and 1132*p*, on hollow portion bottoms 1134 lead back into basin 112 via inner chambers 612). Instead, the fluid outlets on the respective bottoms of the hollow portions of shutter tracks 1562 are fluidly coupled to drain pipe 1538 via a pair of drain ducts 1826. It is noted that such a configuration is particularly suited for manually washing tableware when sink 1800 is in the midst of a washing cycle which effects closed fluid circulation: The fluid coupling of the fluid outlets to drain pipe 1538 ensures that water from faucet does not enter into basin 1512, so that fluids do not accumulate in basin 1512. Accumulation of fluids in basin 1512, resulting in a layer of fluids on base 1512, could potentially obstruct the washing of cups and glasses, as the strength of upright fluid jets ejected by base apertures 1542 (which are used to wash cups and glasses from the inside) would be reduced due to passing through the layer of fluids.

According to some embodiments, basin 1512 includes a slot between second wall 1522*b* and kitchen countertop 1502. The slot is configured to accept a long (and unlinked) edge of a last slat of shutter 1512. The slot includes at least one hole on the bottom thereof which is coupled via a third duct (not shown) to drain pipe 1538, thereby allowing to drain fluids from shutter top surface 1622, which flow into the slot.

Figure 17:
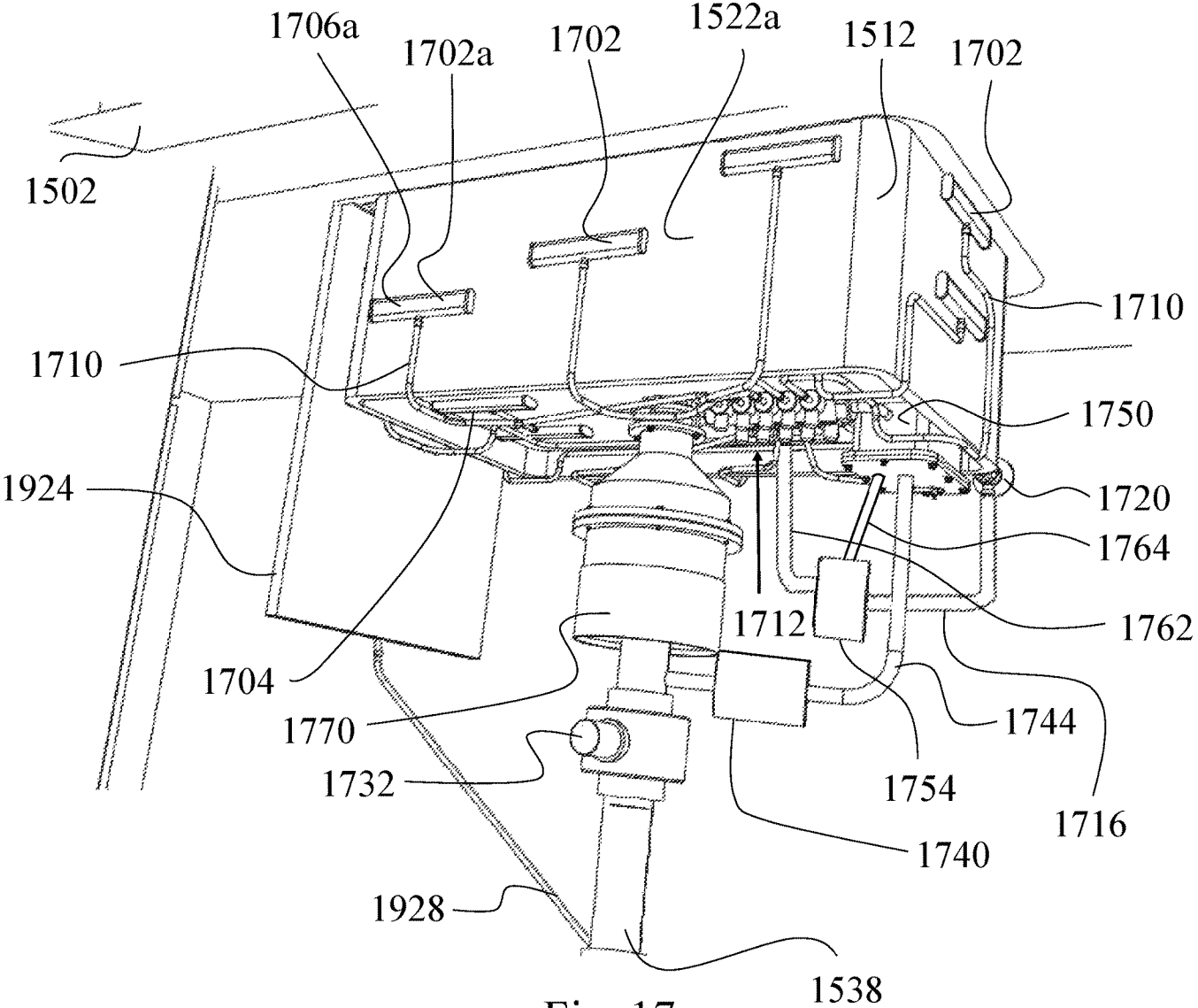
FIG. 17 provides a perspective bottom view of the sink of FIG. 13 depicting infrastructure of the sink, according to some embodiments wherein the sink further includes a sleeve for housing the shutter when the shutter is open.
Figure 18A:
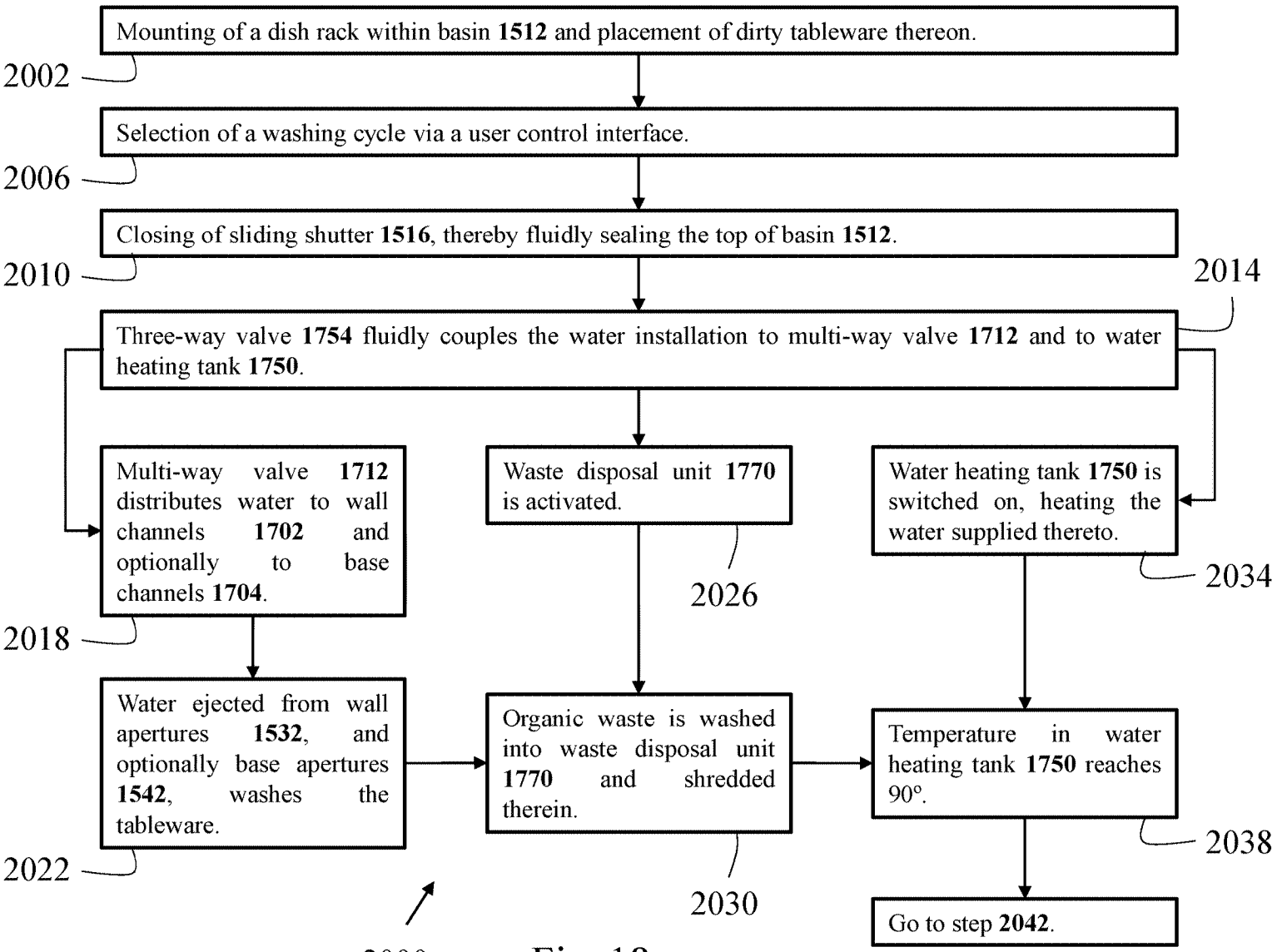
FIGS. 18*a*-18*b* provide a flow-chart of an exemplary washing cycle of the sink of FIG. 13, according to some embodiments.
Figure 18B:
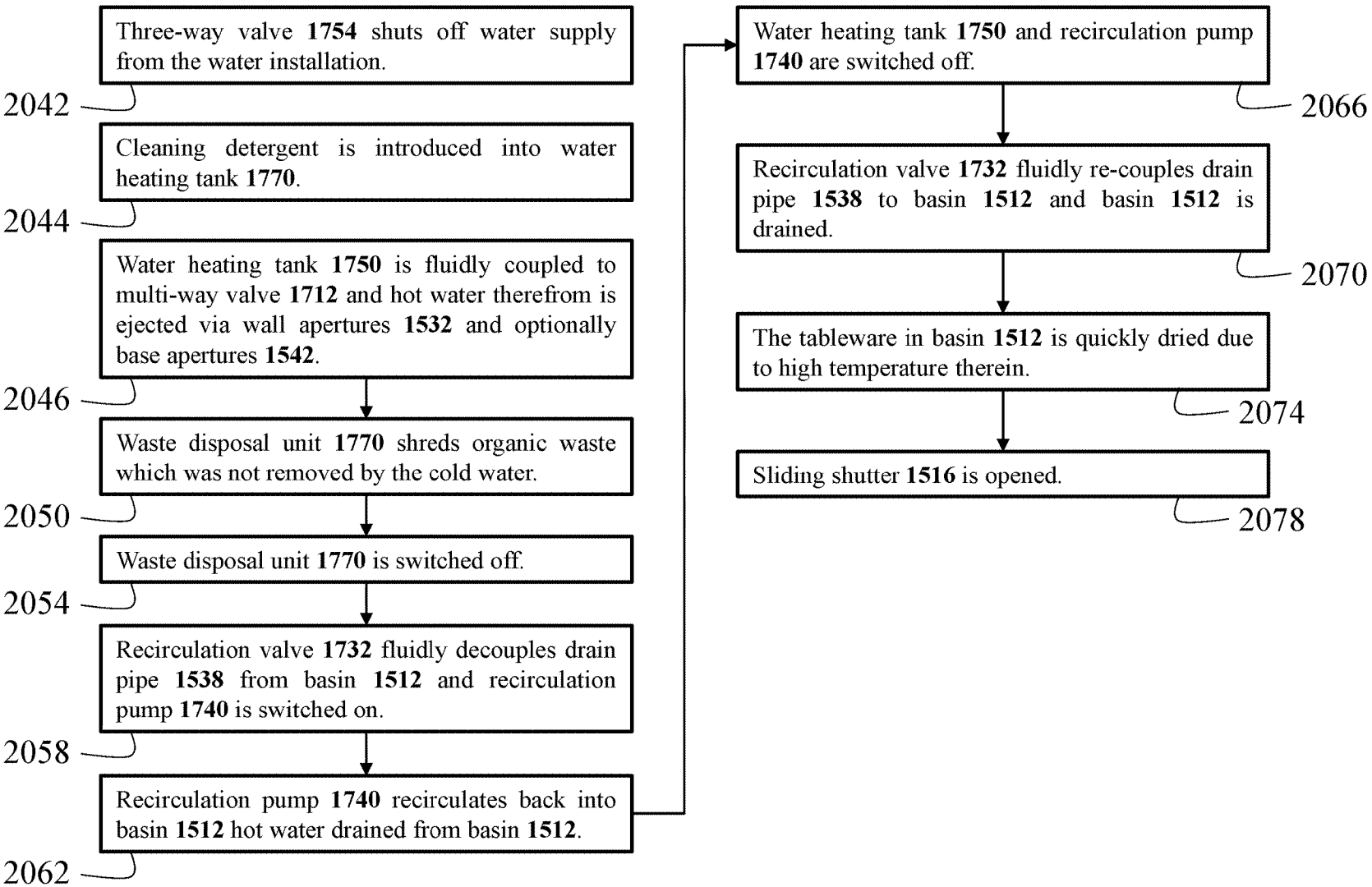

Making reference to FIG. 17, FIG. 17 provides a perspective view of a sink 1900 from below. Sink 1900 is a specific embodiment of sink 1500. Sink 1900 includes a sleeve 1924 adjacent to fourth wall 1522*d* and descending vertically from the top of basin 1512 (in parallel to fourth wall 1522*d*). Sleeve 1924 is rigid, being made of, for example, hard plastic. When shutter 1516 is in the first configuration, shutter 1516 is housed in sleeve 1924.

According to some embodiments, sleeve 1924 includes a drain-hole (not shown) on the bottom thereof. According to some embodiments, a drain duct 1928 is fluidly connected on one end thereof to the drain-hole and on the other end thereof to drain pipe 1538. Drain duct 1928 functions to drain fluids from sleeve 1924.

While drain ducts 1826 are not shown in FIG. 17, it will be understood that the scope of the invention covers embodiments including both drain ducts 1826 and sleeve 1924.

According to some embodiments, wherein sleeve 1924 includes the drain-hole and wherein sink 1500 does not include drain ducts 1826, shutter tracks 1562 are configured to direct water from shutter top surface 1622 into sleeve 1924. According to some such embodiments, shutter 1516 and shutter tracks 1562 are similar to shutter 156 and shutter tracks 162 embodiments depicted in FIGS. 9-10*c* with shutter 1516 including serially linked slats similar to slats 164. Shutter 1516 and shutter tracks 1562 differ from these shutter 156 and shutter tracks 162 embodiments (depicted in FIGS. 9-10*c*) in that shutter tracks 1562 do not include fluid outlets on the bottom surfaces of the hollow portions thereof (i.e. of shutter tracks 1562), so that water drained onto the hollow portions goes on to flow into sleeve 1924. According to some such embodiments, the bottom surfaces are tilted in the sense that each of the bottom surfaces slightly descends from second wall 1522*b* onto fourth wall 1522*d*. The tilting expedites the draining of fluids from the hollow portions into sleeve 1924. The tilting angle of shutter tracks 1562 is between about 1° to about 3°.

According to some embodiments, shutter tracks 1562 are slightly inclined, such as to descend from second wall 1522*b* onto fourth wall 1522*d*. Further, the narrow gap between the top of fourth wall 1522*d* and kitchen countertop 1502 is dimensioned such that a thin space is present between shutter top surface 1622 and kitchen countertop 1502 when shutter 1516 is in the second configuration (i.e. shutter 1516 is closed). Due to the inclination of shutter tracks 1562, shutter is 1516 is also inclined when in the second configuration, so that water on shutter top surface 1622 flows along shutter top surface 1622 towards fourth wall 1522*d*, entering sleeve 1924 via the thin space between shutter top surface 1622 and kitchen countertop 1502.

According to some embodiments, water heating tank 1750 is further configured for generating steam and releasing the steam into basin 1512, similarly to steam tank 308 in sink 100.

According to some embodiments, shutter 1516 includes on one the of slats thereof a bore for affixing thereon a bowl, such as bowl 1300, essentially as depicted in FIG. 11 and the accompanying description thereof.

Exemplary Washing Cycle of Sink 1500

According to some embodiments of sink 1500, an exemplary washing cycle 2000 of sink 1500 may include the following steps:

- A step 2002, wherein the user mounts a dish rack within basin 1512 and places on the rack dirty tableware and cookware.
- A step 2006, wherein the user selects a washing program via the user control interface.
- A step 2010, wherein shutter 1516 is switched from the first configuration to the second configuration (wherein shutter 1516 fluidly seals basin 1512 from above).
- A step 2014, wherein three-way valve 1754 fluidly couples tap 1720 to both multi-way valve 1712 (via water inlet pipe 1716 and first outlet pipe 1762) and water heating tank 1750 (via water inlet pipe 1716 and second outlet pipe 1764) and water from the water installation flows thereto.
- A step 2018, wherein multi-way valve 1712 distributes water to wall channels 1702 and optionally also to base channels 1704.
- A step 2022, wherein water jets are ejected from wall apertures 1532 and optionally from base apertures 1542.
- A step 2026, wherein waste disposal unit 1770 is activated.
- A step 2030, wherein organic waste (food remains) is washed via drain 1534 into waste disposal unit 1770, and is shredded therein.
- A step 2034, wherein water heating tank 1750 is switched on, heating the water supplied thereto, as water heating tank 1750 gradually fills.
- A step 2038, wherein the temperature within water heating tank 1750 reaches 90° C.
- A step 2040, wherein cleaning detergent is introduced into water heating tank 1750.
- A step 2042, wherein three-way valve 1754 shuts off the water supply from the water installation.
- A step 2046, wherein multi-way valve 1712 is fluidly coupled to water heating tank 1750. Hot water, mixed with cleaning detergent, from water heating tank 1750 is distributed via multi-way valve 1712 and is ejected via wall apertures 1532 and optionally base apertures 1542.
- A step 2050, wherein waste disposal unit 1770 shreds organic waste which was not removed by the cold water.
- A step 2054, wherein waste disposal unit 1770 is switched off.
- A step 2058, wherein recirculation valve 1732 fluidly decouples drain pipe 1538 from basin 1512 and recirculation pump 1740 is switched on.
- A step 2062, wherein hot water/fluid (water mixed with cleaning detergent) drained from basin 1512 is recirculated back into basin 1512 via recirculation pump 1740, pipe 1744, water heating tank 1750, multi-way valve 1712, and wall apertures 1532 and optionally base apertures 1542. Closed hot water circulation is thereby effected.
- A step 2066, wherein water heating tank 1770 and recirculation pump 1740 are switched off.
- A step 2070, wherein recirculation valve 1732 fluidly re-couples drain pipe 1538 to basin 1512. Basin 1512 is drained of water.
- A step 2074, wherein the tableware and cookware in basin 1512 is quickly dried due to the high temperature therein.
- A step 2078, wherein shutter 1516 is opened.

Making reference again to sink 100, according to some embodiments thereof, sink 100 includes an additional valve and an additional pump, similar to recirculation valve 1732 and recirculation pump 1740, respectively, thereby allowing sink 100 to implement washing cycle programs incorporating closed water circulation, essentially as explained in the description of washing cycle 2000 of sink 1500.

According to some embodiments of sink 100, sink 100 includes a sleeve, similar to sleeve 1924, for housing shutter 156 when shutter 156 is in the first configuration. According to some such embodiments, shutter 156 includes a drain hole and a drain duct fluidly connected to drain pipe 230. In such embodiments, shutter horizontal segments 1102 do not include fluid outlets 1132. Instead, hollow portions bottoms 1134 are slightly tiled, being thereby configured to direct fluid in hollow portions 1114 into the shutter sleeve, essentially as described above with respect shutter sleeve 1924 of sink 1500. It is noted that in such embodiments wherein sink 100 further includes an additional valve and an additional pump similar to recirculation valve 1732 and recirculation pump 1740, the draining of any fluids on the top of shutter 156 into the shutter sleeve (and therefrom directly onto the sewer), instead of back into basin 112 via inner chambers 612, allows using faucet 106 also when sink 100 is in the midst of a phase of a washing cycle wherein closed water/fluid circulation is effected. In particular, if water from faucet 106 were to be directed into basin 112 (instead of onto the sewer) when sink 100 is running a phase of a washing cycle wherein washing fluids drained via drain 134 are recirculated back into basin 112, then fluids would accumulate on base 124 decreasing the strength of fluid jets ejected from base apertures 148, as elaborated on above.

According to some embodiments, bowl 1300 includes on the base thereof at least one magnet, configured to reversibly attach bowl 1300 to shutter 156. According to some such embodiments, bowl 1300 includes a plurality of orifices configured to drain water from bowl 1300 onto the top surface of shutter 156 and therefrom onto the sleeve (shutter sleeve) via shutter tracks 162 hollow portions 1114. Such embodiments are configured to allow using bowl 1300 when sink 100 is running a closed circulation washing cycle, as elaborated herein.

According to some embodiments of sink 100, the fluid outlets on the respective bottoms of the hollow portions of shutter horizontal segments 1102 (such as fluid outlet 1132*q* on hollow portion bottom 1134*q*) do not lead back to inner chambers 612, but instead are connected to drain ducts which lead to drain pipe 230 similarly to drain ducts 1826 of sink 1500. It is noted that in such embodiments wherein sink 100 includes further an additional valve and an additional pump similar to recirculation valve 1732 and recirculation pump 1740, faucet 106 may be used also when sink 100 is in the midst of a phase of a washing cycle wherein closed water/fluid circulation is effected.

As used herein, according to some embodiments, the term "tableware" is used to refer both to tableware and cookware.

As used herein, according to some embodiments, the terms "food waste", "food remains", and "organic waste" are used interchangeably.

As used herein, according to some embodiments, the terms "steam tank" and "water heating tank" are used interchangeably.

As used herein, the terms "rack" and "dish rack" are used interchangeably.

It is appreciated that certain features of the disclosed technology, which are, for clarity, described in the context of separate embodiments, may also be provided in combination in a single embodiment. Conversely, various features of the disclosed technology, which are, for brevity, described in the context of a single embodiment, may also be provided separately or in any suitable sub-combination or as suitable in any other described embodiment of the disclosed technology. No feature described in the context of an embodiment is to be considered an essential feature of that embodiment, unless explicitly specified as such.

Although steps of methods according to some embodiments may be described in a specific sequence, disclosed methods may comprise some or all of the described steps carried out in a different order. A disclosed method may comprise all of the steps described or only a few of the described steps. No particular step in a disclosed method is to be considered an essential step of that method, unless explicitly specified as such.

Although the disclosed technology is described in conjunction with specific embodiments thereof, it is evident that numerous alternatives, modifications and variations that are apparent to those skilled in the art may exist. Accordingly, the disclosed technology embraces all such alternatives, modifications and variations that fall within the scope of the appended claims. It is to be understood that the invention is not necessarily limited in its application to the details of construction and the arrangement of the components and/or methods set forth herein. Other embodiments may be practiced, and an embodiment may be carried out in various ways.

The phraseology and terminology employed herein are for descriptive purpose and should not be regarded as limiting. Citation or identification of any reference in this application shall not be construed as an admission that such reference is available as prior art to the invention. Section headings are used herein to ease understanding of the specification and should not be construed as necessarily limiting.

The invention claimed is:

1. A sink incorporating dishwasher functionalities, the sink comprising:

a basin having a base, walls and a cover allowing to fluidly seal said basin from a top thereof, wherein said cover is a shutter;

two elongated shutter tracks mounted on opposite sides of a rim of said basin, wherein said shutter tracks are configured to have slid thereon said shutter;

wherein each of said shutter tracks comprises one or more holes along a respective length thereof, said shutter and said shutter tracks being configured such that fluid reaching said shutter tracks from a shutter top surface of said shutter is drained via said holes on said shutter tracks;

wherein at least one portion of the walls of said basin, extending along two peripheral directions, is double walled, having an outer wall and an inner wall, such as to define an inner chamber there between, said inner chamber being controllably fluidly coupled to a pressurized fluid source and having chamber apertures on said inner wall; and wherein during a washing cycle, said cover seals said basin and fluid jets are ejected via said chamber apertures into said basin.

2. The sink of claim 1, comprising a plurality of double walled portions, each comprising a respective inner chamber, said inner chambers being fluidly connected to respective pipes, said pipes being controllably fluidly coupled to one or more valves, thereby allowing to selectively supply pressurized fluid to said inner chambers.

3. The sink of claim 2, wherein said inner chambers and said chamber apertures are configured such as to allow selectively targeting any one or more of a plurality of regions in said basin.

4. The sink of claim 3, wherein said one or more valves are electronic, and wherein the sink further comprises at least one controller comprising electronic circuitry configured to regulate opening and closing of inlet and outlet ports of said one or more valves, such as to allow said pressurized fluid to be sequentially ejected from one after another of said inner chambers, or from one group of said inner chambers after another group of said inner chambers.

5. The sink of claim 2, wherein said one or more valves comprise at least one multi-way valve comprising a plurality of outlet ports controllably fluidly connected to at least some of said pipes.

6. The sink of claim 5, wherein each of said walls is doubled walled comprising a plurality of adjacent inner chambers, and wherein said at least one controller is configured to regulate the opening and closing of said plurality of outlet ports of said multi-way valve, such that fluid jets ejected from said inner chambers are ejected from one of said inner chambers at a time in a rotating pattern.

7. The sink of claim 1, wherein said basin further comprises:

a drain at the base thereof; and a waste disposal unit fluidly coupled to said drain, and fluidly connected, on the bottom end thereof, to a drain pipe, wherein said drain pipe is fluidly coupled to a sewer.

8. The sink of any one of claim 1, further comprising a pump fluidly coupled to a water installation and configured to supply water at increased pressure, relative to a pressure of the water installation, to said inner chamber.

9. The sink of claim 1, further comprising a water heating tank, wherein said base comprises base apertures, said water heating tank being controllably fluidly coupled to said base apertures.

10. The sink of claim 9, further comprising a second pump, controllably fluidly coupled to a water installation and fluidly connected to said water heating tank, said second pump being configured to supply to said water heating tank water at a pressure higher than a pressure within said water heating tank.

11. The sink of claim 5, further comprising a second multi-way valve, said second multi-way valve being controllably fluidly coupled on an inlet port thereof to said water heating tank, and on a plurality of outlet ports thereof to said base apertures.

12. The sink of claim 1, wherein said shutter comprises a plurality of serially linked slats, wherein ends of said slats are mounted in said shutter tracks, respectively, and wherein said slats comprise on said ends rollers configured to allow for sliding motion of said shutter in said shutter tracks.

13. A sink incorporating dishwasher functionalities, the sink comprising a basin, a shutter and two elongated shutter tracks mounted on opposite sides of a rim of said basin;

wherein said basin comprises wall apertures on walls thereof, said wall apertures being controllably fluidly coupled to a pressurized fluid source;

wherein said shutter is controllably switchable between two configurations:

a first configuration, wherein said basin is uncovered; and a second configuration, wherein said shutter fluidly seals said basin from the top thereof;

wherein said shutter tracks are configured to have slid thereon said shutter, thereby switching between the two configurations;

wherein each of said shutter tracks comprises one or more holes along a respective length thereof, said shutter and said shutter tracks being configured such that fluid reaching said shutter tracks from a shutter top surface of said shutter is drained via said holes on said shutter tracks; and wherein during a washing cycle, said shutter is in the second configuration and fluid jets are ejected via said wall apertures into said basin.

14. The sink of claim 13, wherein said shutter comprises a plurality of serially linked slats, wherein ends of said slats are mounted in said shutter tracks, respectively.

15. A sink incorporating dishwasher functionalities, the sink comprising a basin;

a cover allowing to fluidly seal said basin from the top thereof, wherein said cover is a shutter;

a waste disposal unit; and two elongated shutter tracks mounted on opposite sides of a rim of said basin, wherein said shutter tracks are configured to have slid thereon said shutter;

wherein each of said shutter tracks comprises one or more holes along a respective length thereof, said shutter and said shutter tracks being configured such that fluid reaching said shutter tracks from a shutter top surface of said shutter is drained via said holes on said shutter tracks;

wherein said basin comprises wall apertures on walls thereof and a drain at a base thereof, said drain is not sieved, said wall apertures being controllably fluidly coupled to a pressurized fluid source and said drain being fluidly coupled to said waste disposal unit; and wherein during a washing cycle, said cover seals said basin and fluid jets are ejected via said wall apertures into said basin, at least two of the fluid jets being directed such as to guide waste on said base of said basin, or waste stuck onto said base, onto said drain.

16. The sink of claim 15, wherein the fluids jets functioning to guide waste onto said drain are ejected at a higher pressure than the rest of the fluid jets.

17. The sink of claim 15, wherein the fluids jets functioning to guide waste onto said drain are ejected from wall apertures located on respective bottoms, or near the respective bottoms, of at least two opposite walls from said walls.

18. The sink of claim 13, wherein at least one of the walls of the sink comprises at least one wall channel, the wall channel comprising at least one of the wall apertures, wherein the wall channel is controllably fluidly coupled to the pressurized fluid source.

* * * * *